US006755159B1

(12) United States Patent
Adams et al.

(10) Patent No.: US 6,755,159 B1
(45) Date of Patent: Jun. 29, 2004

(54) VALVE MECHANISMS FOR ELONGATED COMBUSTION CHAMBERS

(75) Inventors: Joseph S. Adams, Salt Spring Island (CA); James E. Doherty, Barrington, IL (US); James W. Robinson, Mundelein, IL (US); Donald L. Van Erden, Wildwood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 12 days.

(21) Appl. No.: 10/347,892

(22) Filed: Jan. 20, 2003

(51) Int. Cl.[7] ..... F02B 71/04
(52) U.S. Cl. ..... 123/46 R
(58) Field of Search ..... 123/46 R, 46 A, 123/46 B, 46 SC, 46 E, 46 H

(56) References Cited

U.S. PATENT DOCUMENTS

| | | | | |
|---|---|---|---|---|
| 4,365,471 A | | 12/1982 | Adams | |
| 4,483,280 A | * | 11/1984 | Nikolich | 123/46 SC |
| 4,510,748 A | | 4/1985 | Adams | |
| 4,665,868 A | | 5/1987 | Adams | |
| 4,773,581 A | | 9/1988 | Ohtsu et al. | |
| 5,191,861 A | | 3/1993 | Kellerman et al. | |
| 6,145,724 A | * | 11/2000 | Shkolnikov et al. | 227/8 |
| 6,520,397 B1 | * | 2/2003 | Moeller | 227/130 |
| 6,619,527 B1 | * | 9/2003 | Moeller | 227/10 |
| 6,695,195 B2 | * | 2/2004 | Nishikawa et al. | 227/10 |
| 2001/0006044 A1 | | 7/2001 | Thieleke et al. | |
| 2001/0006045 A1 | | 7/2001 | Thieleke et al. | |
| 2001/0006046 A1 | | 7/2001 | Thieleke et al. | |

* cited by examiner

*Primary Examiner*—Tony M. Argenbright
*Assistant Examiner*—Hyder Ali
(74) *Attorney, Agent, or Firm*—Lisa M. Soltis; Mark W. Croll; Donald S. Breh

(57) ABSTRACT

A new and improved valve assembly for incorporation within a dual combustion chamber system of a combustion-powered fastener-driving tool comprises a single valve mechanism which can operatively control the ingress of atmospheric air into the combustion chambers, the egress of combustion products out from the combustion chambers, and the fluid flows between the first and second combustion chambers attendant VENTING, MIXING, and FIRING stages of an overall combustion cycle. The valve mechanism may comprise either a rotary valve mechanism, a linear-rotary valve mechanism, or a linear valve mechanism.

41 Claims, 9 Drawing Sheets

VALVE MECHANISMS FOR ELONGATED COMBUSTION CHAMBERS

FIELD OF THE INVENTION

The present invention relates generally to combustion-powered fastener-driving tools, and more particularly to new and improved valve mechanisms operatively integrated within dual combustion chamber systems incorporated within combustion-powered fastener driving tools in order to facilitate and enhance the operational efficiency attendant the introduction and mixing of air-fuel mixtures into and within the dual combustion chambers, as well as to similarly facilitate and enhance the operational efficiency attendant the scavenging and discharge of the combustion products out from the dual combustion chambers.

BACKGROUND OF THE INVENTION

Dual combustion chamber systems have been heretofore incorporated within fastener driving tools, and as a result of the employment of such dual combustion chamber systems within fastener-driving tools, enhanced energy or power output levels have been able to be achieved for optimizing operational characteristics or parameters of the fastener-driving tools in connection with the driving of fasteners into underlying substrates. The dual combustion chamber systems generally comprise separate first and second combustion chambers, wherein a one-way check valve is effectively interposed between the first and second combustion chambers such that fluid flow only occurs in the direction extending out from the first combustion chamber and into the second combustion chamber. In addition, the first combustion chamber usually comprises a substantially elongated tubular structure, while the second combustion chamber usually comprises a substantially shorter, more compact structure. The overall structural arrangement of such dual combustion chamber systems can in fact be rendered compact by forming or fabricating the first combustion chamber in such a manner that the first combustion chamber has a substantially spiral or spool-type structure or configuration, and wherein further, the first combustion chamber effectively surrounds the second combustion chamber. Examples of such dual combustion chamber systems, as incorporated within combustion-powered fastener-driving tools, are disclosed within U.S. patent application Ser. No. 10/050,416 entitled COMBUSTION CHAMBER SYSTEM, which was filed on Jan. 16, 2002 in the name of Joseph S. Adams, and U.S. patent application Ser. No. 10/050,836 entitled COMBUSTION CHAMBER SYSTEM WITH SPOOL-TYPE PRE-COMBUSTION CHAMBER, which was also filed on Jan. 16, 2002 in the name of Joseph S. Adams.

A practical or operational concern in connection with the efficient cyclical operation or functioning of such fastener-driving tools having the aforenoted dual combustion chamber system incorporated therein is the introduction and mixing of the air-fuel mixtures into and within the combustion chambers, as well as the scavenging or discharge of the combustion products out from the combustion chambers. Conventionally, considerable time has in fact been required in order to adequately or properly achieve and complete the aforenoted air-fuel mixture introduction and mixing stages of the fastener-driving operational cycle performed by means of the combustion-powered fastener-driving tool, as well as the achievement and completion of the aforenoted scavenging or discharging stage of the fastener-driving operational cycle performed by means of the combustion-powered fastener-driving tool.

A need therefore exists in the art for a new and improved dual combustion chamber system for incorporation within combustion-powered fastener-driving tools wherein the efficiency of the introduction and mixing of the air-fuel mixtures into and within the combustion chambers, as well as the scavenging or discharge of the combustion products out from the combustion chambers, can be optimized.

OBJECTS OF THE INVENTION

Accordingly, it is an object of the present invention to provide a new and improved dual combustion chamber system of a combustion-powered fastener-driving tool, and new and improved valve mechanisms for incorporation within the dual combustion chamber system of the combustion-powered fastener-driving tool.

Another object of the present invention is to provide a new and improved dual combustion chamber system of a combustion-powered fastener-driving tool, and new and improved valve mechanisms for incorporation within the dual combustion chamber system of the combustion-powered fastener-driving tool, which effectively overcomes the various operational drawbacks and disadvantages characteristic of conventional or PRIOR ART dual combustion chamber systems.

An additional object of the present invention is to provide a new and improved dual combustion chamber system of a combustion-powered fastener-driving tool, and new and improved valve mechanisms for incorporation within the dual combustion chamber system of the combustion-powered fastener-driving tool, wherein the efficiency of the introduction and mixing of the air-fuel mixtures into and within the combustion chambers, as well as the scavenging or discharge of the combustion products out from the combustion chambers, can be optimized.

A further object of the present invention is to provide a new and improved dual combustion chamber system of a combustion-powered fastener-driving tool, and new and improved valve mechanisms for incorporation within the dual combustion chamber system of the combustion-powered fastener-driving tool, wherein the efficiency of the introduction and mixing of the air-fuel mixtures into and within the combustion chambers, as well as the scavenging or discharge of the combustion products out from the combustion chambers, can be optimized, and wherein further, the valve mechanisms may comprise various operational structures, such as, for example, a rotary valve mechanism, a rotary and linear valve mechanism, or a linear valve mechanism.

A last object of the present invention is to provide a new and improved dual combustion chamber system of a combustion-powered fastener-driving tool, and new and improved valve mechanisms for incorporation within the dual combustion chamber system of the combustion-powered fastener-driving tool, wherein the efficiency of the introduction and mixing of the air-fuel mixtures into and within the combustion chambers, as well as the scavenging or discharge of the combustion products out from the combustion chambers, can be optimized by means of a single valve mechanism which can operatively control the ingress of atmospheric air into the combustion chambers, the egress of combustion products out from the combustion chambers, and the fluid flows between the first and second combustion chambers attendant the VENTING, MIXING, and FIRING stages of an overall combustion cycle.

SUMMARY OF THE INVENTION

The foregoing and other objectives are achieved in accordance with the teachings and principles of the present invention through the provision of a new and improved dual combustion chamber system of a combustion-powered fastener-driving tool, and new and improved valve mechanisms for incorporation within the dual combustion chamber system of the combustion-powered fastener-driving tool, wherein, in accordance with a first embodiment of the present invention comprising a rotary valve mechanism, there is provided a valve mechanism which is rotatably movable between three separate and distinct positions so as to fluidically inter-connect the first and second combustion chambers of the dual combustion chamber system, during three different stages of an overall combustion cycle, by passageways other than the passageway or conduit which conventionally connects the first and second combustion chambers and which is controlled either by means of the aforenoted check valve structure or by means of a suitable port or connecting orifice. More particularly, when the rotary valve mechanism is rotated to its first position, corresponding to the first VENTING stage of the combustion cycle, and disposed at such position for a predetermined period of time as a result of the completion of a previous FIRING stage of the combustion cycle and the removal of the tool from its engaged position with the underlying substrate or workpiece, atmospheric air is introduced into the first combustion chamber, the air and combustion products, which are present within the first combustion chamber from a previous FIRING stage, are transmitted from the first combustion chamber into the second combustion chamber, and the air and combustion products, which are present within the second combustion chamber from the previous FIRING stage, are exhausted from the second combustion chamber to atmosphere.

When the rotary valve mechanism is subsequently rotated to its second position, corresponding to the second MIXING stage of the combustion cycle, and disposed at such position for a predetermined period of time as a result of the tool being disposed in contact with the underlying substrate or workpiece and prior to the initiation of the FIRING stage of the combustion cycle by means of the tool trigger mechanism, atmospheric air is no longer introduced into the first combustion chamber, and combustion products are no longer exhausted from the combustion chambers to atmosphere. To the contrary, fuel is introduced into the first combustion chamber, and the resulting air-fuel mixture is continuously circulated from the first combustion chamber into the second combustion chamber, and from the second combustion chamber back into the first combustion chamber, so as to achieve good MIXING of the air-fuel mixture. After the MIXING stage of the combustion cycle has been completed for a period of time until the FIRING stage of the combustion cycle is initiated by means of the tool operator actuating the tool trigger mechanism, the rotary valve mechanism is rotated to its third FIRING position as a result of the actuation of the tool trigger mechanism, and is disposed at such position for a period of time during which the FIRING stage of the combustion cycle is achieved and until the tool is released from its engaged position with the underlying workpiece or substrate.

During the FIRING stage of the combustion cycle, the air-fuel mixture is ignited within the first combustion chamber, and it is noted that the first combustion chamber is only fluidically connected to the second combustion chamber through means of the fluid passageway controlled by either the aforenoted check valve or the port or connecting orifice. Accordingly, the flame front travels through the first combustion chamber, the flame front then passes into the second combustion chamber thereby igniting the combustible air-fuel mixture present within the second combustion chamber, and the energy or power generated within the second combustion chamber is directed against a suitable piston-driver assembly which operatively drives a fastener out from the combustion-powered tool and into the substrate or workpiece. After the tool has been fired and the fastener has been driven into the workpiece or substrate, the trigger mechanism is deactuated and the tool is removed from its engaged position with the substrate or workpiece so as to permit the rotary valve mechanism to again be rotated to its first VENTING position whereby fresh air can again be introduced into the combustion chambers such that combustion products can again be exhausted, purged, or scavenged from the combustion chambers in preparation for a new or subsequent combustion cycle.

In accordance with a second embodiment of the present invention which comprises a combination linearly and rotary movable valve mechanism, the valve mechanism likewise includes suitable structural components which cooperate together so as to be capable of similarly performing the various operational steps, characteristic of the aforenoted VENTING, MIXING, and FIRING stages of the combustion cycle, as were able to be performed by means of the aforenoted rotary valve mechanism. More particularly, a first valve housing or component, having the first serpentine combustion chamber defined therein, annularly surrounds a second valve housing or component which defines the second combustion chamber therein. The first valve housing or component is linearly movable with respect to the second valve housing or component, and is also rotatable with respect to the second valve housing or component. Accordingly, when the first and second valve housings or components are disposed at first positions with respect to each other, fresh air is admitted into the second combustion chamber, the fresh air is then conducted into and through the first combustion chamber, and the fresh air is then exhausted into the atmosphere whereby combustion products, present within the first and second combustion chambers from a previous FIRING stage of the overall combustion cycle, are VENTED, PURGED, or SCAVENGED.

Subsequently, when the first valve housing or component is linearly moved with respect to the second valve housing or component as a result of the combustion-powered tool being forced into contact with the workpiece or substrate into which a fastener is to be driven, the fresh air intake and exhaust ports are closed, fuel is injected into the first combustion chamber, and the air-fuel mixture is recirculated through the first and second combustion chambers so as to achieve the MIXING stage of the over-all combustion cycle until the operator initiates ignition. Subsequently, upon completion of the MIXING stage of the combustion cycle, when the FIRING stage of the combustion cycle is to be initiated, the first valve housing or component is rotated with respect to the second valve housing or component, as a result of being operatively connected to the tool trigger mechanism, whereupon the air-fuel mixture being ignited within the first combustion chamber, the flame front traverses the first combustion chamber, enters the second combustion chamber through means of the one-way check valve, port, or orifice separating the first combustion chamber from the second combustion chamber, and ignites the air-fuel mixture present within the second combustion chamber so as to in fact initiate the FIRING stage of the combustion cycle. Accordingly, the energy and power generated by means of such combustion within the second combustion chamber acts upon a suitable piston-driver assembly of the fastener-driving tool for driving a fastener out from the combustion-powered fastener-driving tool.

In accordance with a third embodiment of the present invention which comprises a linearly movable valve mechanism, the valve mechanism likewise includes suitable structural components which cooperate together so as to be capable of similarly performing the various operational steps, characteristic of the aforenoted VENTING, MIXING, and FIRING stages of the combustion cycle, as were able to be performed by means of the aforenoted rotary and combination linear-rotary valve mechanisms. More particularly, the linearly movable valve housing or component, having the first serpentine combustion chamber defined therein, annularly surrounds the second combustion chamber therein. The first and second combustion chambers have fluid passageways defined therein which are adapted to be fluidically aligned with respect to each other or non-aligned with respect to each other in order to achieve the various VENTING, MIXING, and FIRING stages of the combustion cycle. More particularly, when the outer valve housing is disposed at a first position, the fluid passageways of the first and second combustion chambers are aligned with respect to each other, and intake air and exhaust air are permitted to enter into the combustion chambers and exit out from the combustion chambers so as to achieve the VENTING of the first and second combustion chambers. When the outer valve housing is linearly moved to a second position as a result of the tool being disposed in contact with the underlying workpiece or substrate, the intake and exhaust ports are closed, however, the first and second combustion chambers are still fluidically connected to each other through means of the fluid passageways so as to achieve MIXING of the air-fuel mixture within the first and second combustion chambers. When the outer valve housing is linearly moved still further to its third position as a result of the actuation of the tool trigger mechanism, the fluidic passageways between the first and second combustion chambers are closed or no longer aligned with each other whereby combustion, initiated within the first combustion chamber, can only be conveyed into the second combustion chamber through means of the one-way check valve, or the port or orifice, so as to achieve the desired FIRING stage of the combustion cycle. Return of the outer housing to its first position, as a result of the deactuation of the tool trigger mechanism and the disengagement of the tool with respect to the substrate or workpiece, facilitates a new VENTING cycle.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIG. 3, are adapted to be fixedly mounted so as to complete the first embodiment of the dual combustion chamber assembly constructed in accordance with the principles and teachings of the present invention;

DETAILED DESCRIPTION OF THE PREFERRED EMBODIMENT

Figure 1A:
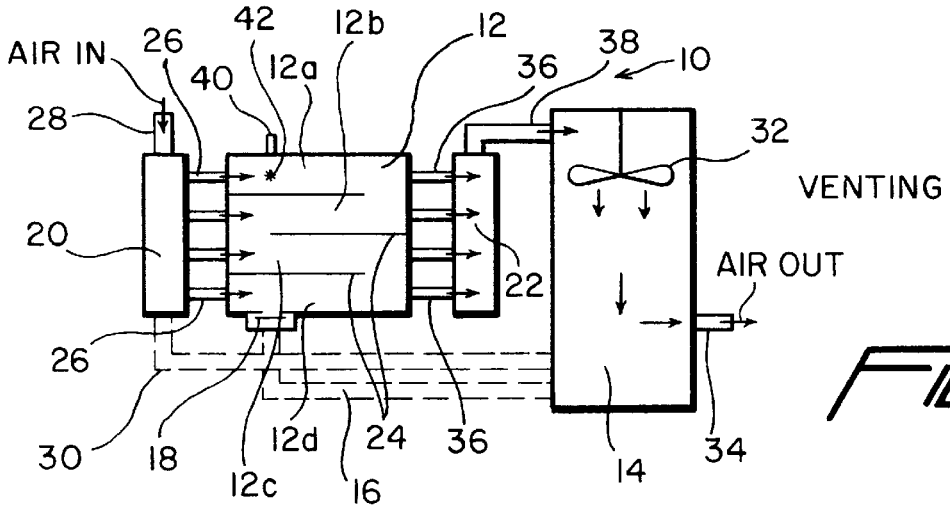
FIGS. 1*a*, 1*b*, and 1*c* are schematic views showing the first and second combustion chambers of a dual combustion chamber system which, in addition to being fluidically connected together by a fluid passageway controlled by means of a one-way check valve, or alternatively by means of a suitable port or orifice, are fluidically connected together by additional fluid passageways which are controlled by means of a three-position rotary valve mechanism which, when disposed at its three different rotary positions, enables the VENTING, MIXING, and FIRING stages of the overall combustion cycle to be efficiently performed.
Figure 1B:
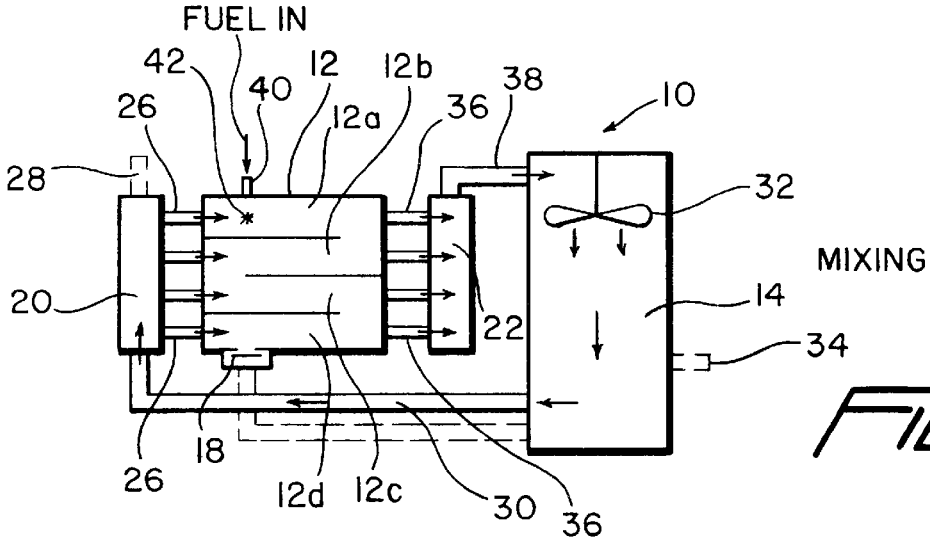
Figure 1C:
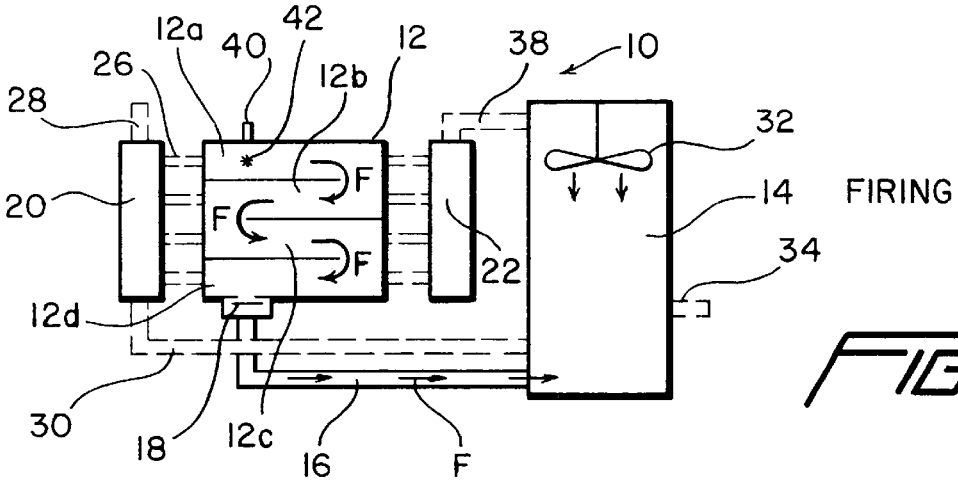

Referring now to the drawings, and more particularly to FIGS. 1*a*–1*c* thereof, a schematic illustration of the various fluid flow paths characteristic of the three VENTING, MIXING, and FIRING stages of a combustion cycle, as controlled, for example, by means of each one of the three embodiments of the new and improved valve mechanisms, constructed in accordance with the principles and teachings of the present invention, will first be described, and subsequently, the detailed structure comprising each one of the three embodiments of the new and improved valve mechanisms, constructed in accordance with the principles and teachings of the present invention, for achieving the various fluid flow paths characteristic of the three VENTING, MIXING, and FIRING stages of the combustion cycle, will be described. As is illustrated, for example, within FIG. 1*a*, the dual combustion chamber system, as may be incorporated within a combustion-powered fastener-driving tool, is generally indicated by the reference character 10 and is seen to comprise a first combustion chamber 12, and a second combustion chamber 14. The first combustion chamber 12 is normally fluidically connected to the second combustion chamber 14 by means of a fluid passageway 16, and a one-way check valve, port, or orifice 18 is disposed within the upstream end of the fluid passageway 16 so as to control the propagation of the flame front and the flow of the resulting combustion out from the first combustion chamber 12 and into the second combustion chamber 14. A first plenum chamber 20 is fluidically disposed upstream of the first combustion chamber 12, and a second plenum chamber 22 is interposed between the first and second combustion chambers 12,14 so as to be fluidically disposed downstream from the first combustion chamber 12 but fluidically disposed upstream of the second combustion chamber 14.

The first combustion chamber 12 is divided into a plurality of segments 12*a*,12*b*,12*c*,12*d* by means of a plurality of partitions 24, whereby the entire interior of the first combustion chamber 12 has a sinusoidal flow path defined therein, and a plurality of passageways 26 respectively fluidically interconnect each one of the first combustion chamber segments 12*a*,12*b*,12*c*,12*d* to the first plenum chamber 20. It is additionally seen that a first upper end portion of the first plenum chamber 20 has an air intake port 28 fluidically connected thereto, and a fluid passageway 30 fluidically connects a second lower end portion of the first plenum chamber 20 to the second combustion chamber 14. A fluid circulation fan 32 is disposed within an upstream or fan intake end of the second combustion chamber 14, and an exhaust port 34 is fluidically connected to a downstream or fan discharge end of the second combustion chamber 14. In a manner similar to that characteristic of the fluidic connections defined between the first plenum chamber 20 and each one of the segments 12*a*,12*b*,12*c*,12*d* of the first combustion chamber 12, it is seen that each one of the first combustion chamber segments 12*a*,12*b*,12*c*,12*d* is also respectively fluidically connected to the second plenum chamber 22 by means of a plurality of fluid passageways 36, although the actual number of fluid passageways may actually vary. In addition, the upstream or fan intake end portion of the second combustion chamber 14 is fluidically connected to the upper end of the second plenum chamber 22 by means of a fluid passageway 38.

In light of the foregoing, it can readily be appreciated that when, for example, the rotary valve mechanism, which is not shown within FIGS. 1*a*–1*c* but which is illustrated within FIGS. 2–9 and which will subsequently be described in detail in connection with its various structural components, is rotated to its first position such that the VENTING stage of the combustion cycle can be performed in conjunction with the first and second combustion chambers 12,14, the various structural and fluidic components of the dual combustion chamber system 10 are as illustrated within FIG. 1*a*. It is noted, for example, that in conjunction with FIG. 1*a*, the fluid passageways illustrated in solid lines have fluids flowing through them, while the fluid passageways illustrated in dotted lines do not have fluids flowing through them.

More particularly then, as a result of the rotary valve mechanism being disposed at its first position, whereby the various components of the dual combustion chamber system 10 are in fact as illustrated within FIG. 1*a* so as to enable the VENTING stage of the combustion cycle to be performed, fresh atmospheric air is admitted into the first plenum chamber 20 through means of air inlet port 28, and since each one of the first combustion chamber segments 12*a*, 12*b*,12*c*,12*d* is respectively fluidically connected to the first plenum chamber 20 through means of the plurality of fluid passageways 26, the incoming air is conducted into each one of the first combustion chamber segments 12*a*,12*b*, 12*c*,12*d*. In a similar manner, since each one of the first combustion chamber segments 12*a*,12*b*,12*c*,12*d* is respectively fluidically connected to the second plenum chamber 22 by means of the plurality of fluid passageways 36, the incoming air, and any combustion products present within the first combustion chamber 12 from a previous FIRING stage, are transmitted into the second plenum chamber 22. In turn, in view of the fact that the second plenum chamber 22 is fluidically connected to the fan intake end portion of the second combustion chamber 14 through means of the fluid passageway 38, the operation of the fan 32 facilitates the introduction of the incoming VENTING or PURGING air into the second combustion chamber 14 and the exhaust of such VENTING or PURGING air, along with any combustion products present within the second combustion chamber 14 from a previous FIRING stage, from the second combustion chamber 14 through means of the exhaust port 34. It is to be noted that while fan 32 is illustrated as being disposed within the second combustion chamber 14 as a means for achieving the aforenoted fluid circulation, other means may alternatively be employed for achieving such fluid or flow circulation. For example, the fan 32 may be disposed externally of the second combustion chamber 14, a fan or blower may be fluidically connected to or disposed within the first combustion chamber 12, a supply of compressed or pressurized air may be fluidically connected to either one of the first or second combustion chambers 12,14, or the like. Still further, the fluid flow, characteristic of the VENTING, PURGING, or SCAVENGING stage of the combustion cycle, can be conducted in a direction which is opposite that illustrated.

Once the VENTING or PURGING stage has been completed within a predetermined period of time, the rotary valve mechanism is rotated to its second position, by means, for example, of the combustion-powered fastener-driving tool being disposed in contact with a workpiece or substrate into which a fastener is to be driven, in order to permit the second MIXING stage of the combustion cycle to be performed. More particularly, fuel is injected into the first combustion chamber segment 12*a* through means of a fuel injection port 40, and as a result of the rotary valve mechanism being disposed in its second rotary position, it is seen that both the air intake port 28 and the exhaust port 34 are now closed. Concomitantly, the fluid passageway 30, which fluidically connects the fan exhaust end portion of the second combustion chamber 14 to the first plenum chamber 20, is now opened, and in this manner, MIXING or CIRCULATION of the air-fuel mixture is effectively conducted throughout the first and second combustion chambers 12,14 as also facilitated or assisted by means of fan 32 or the other aforenoted fluid flow mechanisms. In conjunction with the aforenoted reversed fluid flow through the first and second combustion chambers, it is likewise noted that, alternatively, in lieu of the fuel being injected into the first combustion chamber segment 12*a* through means of a fuel injection port 40, fuel can likewise be injected into the second combustion chamber 14. Once the MIXING or RECIRCULATION operation or cycle has been conducted for a period of time, that is, until the trigger mechanism of the combustion-powered fastener-driving tool is actuated, the rotary valve mechanism is then rotated to its third rotary position, as a result of the trigger mechanism of the combustion-powered fastener-driving tool being actuated, so as to place the combustion-powered fastener-driving tool in condition to implement the FIRING stage of the combustion cycle.

The FIRING stage of the combustion cycle is initiated as a result of the firing or activation of a spark plug or similar ignition device 42 which is located within the first combustion chamber segment 12*a* at a position adjacent to the fuel injection port 40, and it is seen that as a result of the rotary valve mechanism being rotated to its third rotary position, as when the tool trigger mechanism is actuated, the fluid passageway 30 interconnecting the second combustion chamber 14 to the first plenum chamber 20 is now closed, as are the plurality of fluid passageways 26 fluidically interconnecting the first plenum chamber 20 to the first combustion chamber segments 12*a*,12*b*,12*c*,12*d*, and the plurality of fluid passageways 36 fluidically interconnecting the first combustion chamber segments 12*a*,12*b*,12*c*,12*d* to the second plenum chamber 22. Conversely, however, it is seen that fluid passageway 16 is now opened, as a result of the flow through the one-way check valve 18, or the suitable port or orifice, so as to permit the flame front and generated combustion to proceed through the first combustion chamber segments 12*a*,12*b*,12*c*,12*d*, as denoted by means of the arrows F, out from the first combustion chamber 12, and into the second combustion chamber 14 through means of the check valve mechanism 18, or port or orifice, and the fluid passageway 16. Upon completion of the FIRING stage of the combustion cycle, the rotary valve mechanism is again rotated back to its first rotary position corresponding to the VENTING stage of the combustion cycle, as a result of the deactuation of the tool trigger mechanism and the disengagement of the tool from the workpiece or substrate, whereby a subsequent combustion cycle can be implemented.

Figure 2:
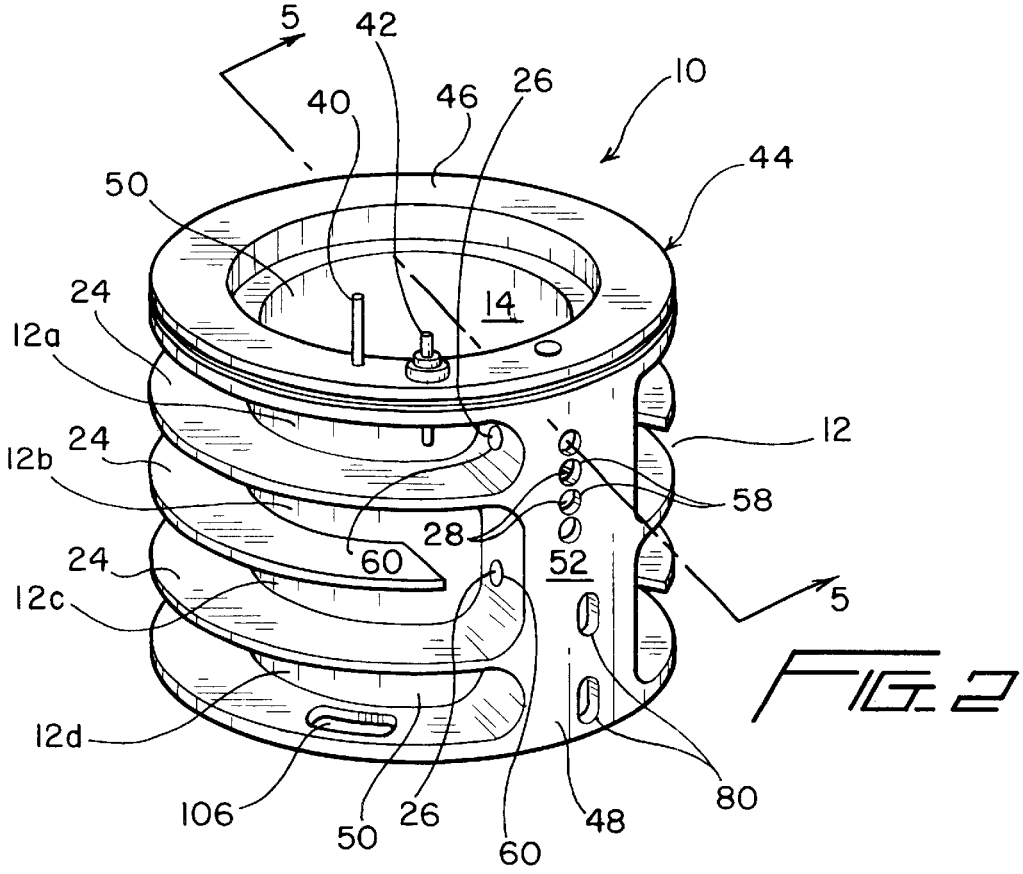
FIG. 2 is a perspective view of a first embodiment of a combustion chamber body member which effectively defines a first embodiment of a new and improved dual combustion chamber system, constructed in accordance with the principles and teachings of the present invention, wherein the first upstream combustion chamber comprises a peripherally outer combustion chamber having a sinusoidal or convoluted configuration, wherein the second downstream combustion chamber comprises a centrally located cylindrical combustion chamber which is annularly surrounded by means of the first peripherally outer combustion chamber, and wherein further, a rotary valve mechanism, not shown in FIG. 2, is adapted to be mounted within the combustion chamber body member so as to be rotatably movable between three separate and distinct rotary positions with respect to the combustion chamber body member in order to facilitate the operation of the aforenoted VENTING, MIXING, and FIRING stages of the combustion cycle.
Figure 3:
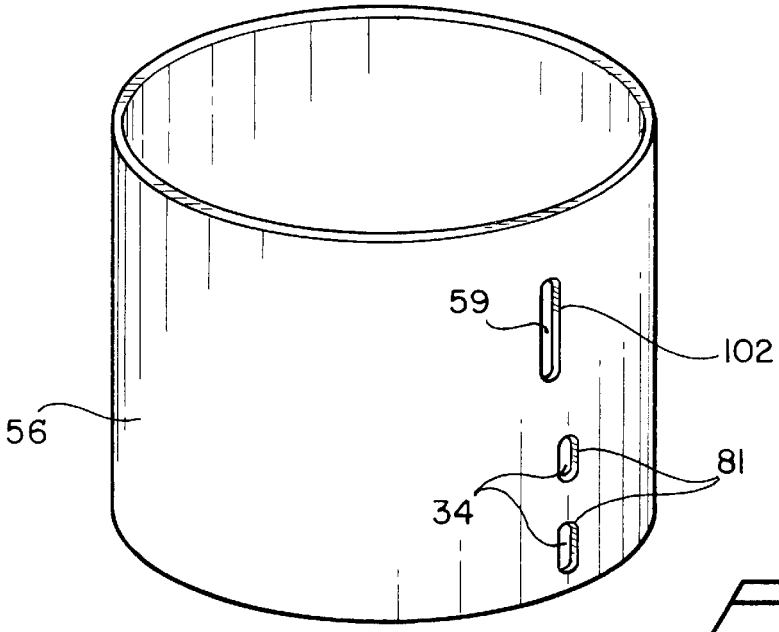
FIG. 3 is a perspective view of a tubular casing or housing member which is adapted to be fixedly disposed around the combustion chamber body member as illustrated within FIG. 2 so as to effectively encase, close, and seal the annular first upstream combustion chamber.

With reference now being made to FIGS. 2–9, the specific structural details of the first embodiment of the dual combustion chamber system 10 of the present invention, having the first rotary valve mechanism embodiment of the present invention operationally incorporated therein for achieving the aforenoted VENTING, MIXING, and FIRING stages of the combustion cycle, will be disclosed and discussed. More particularly, it is seen that the first embodiment of the dual combustion chamber system 10 is seen to comprise a combustion chamber body member 44 which has a tubular configuration as defined by means of an annular wall structure 46. The annular wall structure 46 comprises an outer peripheral wall member or surface 48 and an inner peripheral wall member or surface 50. The outer peripheral wall member or surface 48 is spaced radially outwardly from or with respect to the inner peripheral wall member or surface 50, and a tubular rotary valve housing 52, for accommodating or containing a rotary valve member 54, as disclosed within FIGS. 5–9, is defined at a predetermined circumferential position within the annular wall structure 46. The aforenoted plurality of vertically spaced, substantially annular partitions 24 are integrally fixed to the inner peripheral wall member or surface 50, and it is further seen that alternative ones of the partitions 24 are integrally connected to opposite sides of the rotary valve housing 52. In this manner, the plurality of partitions 24 effectively define the plurality of sinusoidal or serpentine segments 12*a*,12*b*,12*c*,12*d* of the first combustion chamber 12, and it is to be further appreciated that the inner peripheral wall member or surface 50 defines the second combustion chamber 14. Still further, when a tubular casing or housing member 56, as illustrated within FIG. 3, is fixedly disposed around the external periphery of the combustion chamber body member 44, the plurality of segments 12*a*,12*b*,12*c*,12*d* of the first combustion chamber 12 will of course be fluidically enclosed.

With reference still being made to FIGS. 2 and 3, it is further seen that a plurality of first apertures 58 are provided within the outer peripheral wall member or surface portion of the rotary valve housing 52, and an elongated aperture 59 is provided within the combustion chamber tubular casing or housing member 56 whereby such apertures 58,59 together effectively define the air intake ports 28. It is also seen that a plurality of second apertures 60 are defined within a left side portion of the rotary valve housing 52 so as to effectively define the fluid passageways 26 which fluidically lead into the plurality of segments 12*a*, 12*b*,12*c*,12*d* of the first combustion chamber 12, and a plurality of third apertures, not visible in the drawings but similar to the plurality of second apertures 60, are likewise defined within a right side portion of the rotary valve housing 52 so as to effectively define the fluid passageways 36 which fluidically lead out of the plurality of segments 12*a*,12*b*,12*c*,12*d* of the first combustion chamber 12.

As can be additionally appreciated from FIGS. 5–9, it is seen that the rotary valve member 54 comprises an upstanding control shaft portion 62, and a cylindrical shank or body portion 64. A first relatively long, axially oriented planar portion 66 is formed in a radially recessed manner within a first side region of the rotary valve cylindrical shank or body portion 64 so as to effectively define the first plenum chamber 20, while a second relatively short, axially oriented planar portion 68 is similarly formed in a radially recessed manner within a diametrically opposed second side region of the rotary valve cylindrical shank or body portion 64 so as to effectively define the second plenum chamber 22. It is to be particularly appreciated that the first planar portion 66 formed within the first side region of the rotary valve shank or body portion 64 is defined by left and right vertically or axially oriented side edges 70, 72 as viewed in FIG. 6, while the second planar portion 68 formed within the second side region of the rotary valve shank or body portion 64 is similarly defined by left and right vertically or axially oriented side edges 74,76 as viewed in FIG. 9, the significance of such structure becoming more apparent shortly hereinafter.

It is further appreciated from FIGS. 2,3,5,7, and 8 that a pair of vertically spaced, diametrically oriented through-bores 78 are formed within a lower region of the rotary valve shank or body portion 64, a pair of vertically spaced apertures 80 are formed within a lower region of the outer peripheral wall member or surface 48 of the tubular rotary valve housing 52, and a pair of vertically spaced apertures 81 are formed within a lower region of the combustion chamber tubular casing or housing member 56. In addition, as can be seen and appreciated from FIG. 5, a vertically elongated aperture 82 is likewise formed within a lower region of the interior peripheral wall member or surface 50 of the combustion chamber body member 44, and in this manner, when the rotary valve member 54 is rotated so as to be disposed at its first rotary position at which the VENTING stage of the combustion cycle can be performed, the through-bores 78 of the rotary valve shank or body portion 64 will be fluidically aligned with and fluidically connected to the elongated aperture 82 of the combustion chamber body member 44, the apertures 80 formed within the tubular rotary valve housing 52, and the apertures 81 formed within the combustion chamber tubular casing or housing member 56 so as to effectively define the exhaust ports 34 which fluidically lead out from the second combustion chamber 14. It is also noted from FIG. 5 that a pair of apertures 84 are formed within an upper region of the interior peripheral wall member or surface 50 of the combustion chamber body member 44, and as will be more fully appreciated hereinafter, the apertures 84 effectively define the fluid passageways 38 leading into the upper, fan-suction side of the second combustion chamber 14.

Figure 4:
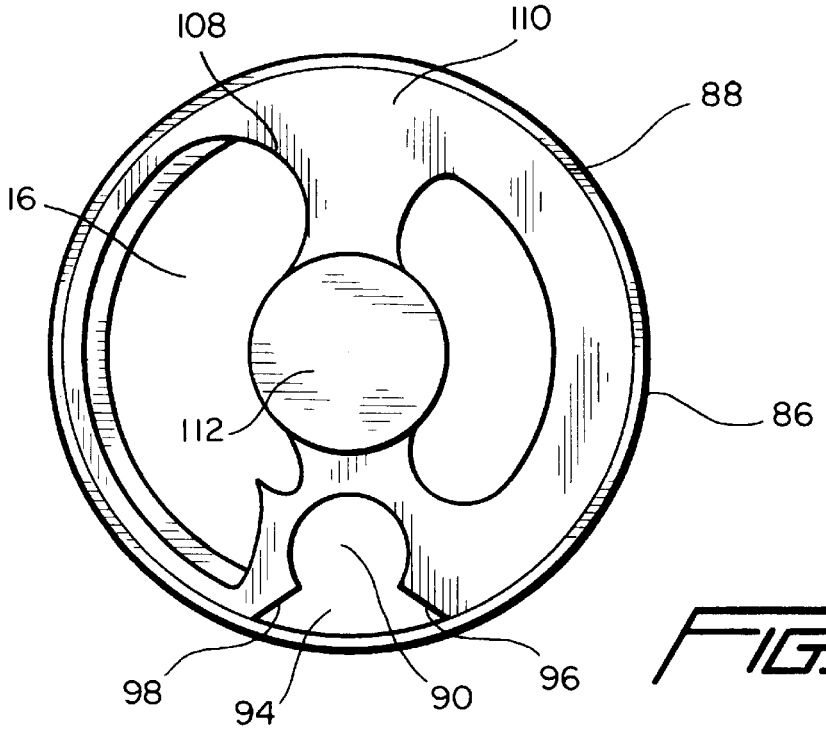
FIG. 4 is a top plan view of a base member upon which the combustion chamber body member, as illustrated within FIG. 2, as well as the tubular casing or housing member, as illustrated within

In order to substantially complete the structural components of the combustion chamber system 10, a combustion chamber base member 86 is disclosed within FIG. 4, and it is seen that the combustion chamber base member 86 comprises an annular stepped or flanged portion 88 upon which the lower circumferential or peripheral edge portion of the combustion chamber tubular casing or housing member 56 is adapted to be seated. In addition, it is further seen that the base member 86 has a substantially circular vertically recessed portion 90 defined therein which effectively serves as a rotary bearing member for the lower axial end portion 92 of the rotary valve member 54 which is best seen in FIGS. 6–9. A circumferential section of the substantially circular recess portion 90 is open as at 94, and a pair of limit stops 96,98 are defined upon opposite sides of the open section 94. As can best be seen in FIGS. 7–9, the lower axial end portion 92 of the rotary valve member 54 has a pin 100 projecting radially outwardly therefrom which is adapted to engage the limit stops 96,98 when the rotary valve member 54 is rotated to its extreme rotary positions. Accordingly, in this manner, when the rotary valve member 54 has been rotated such that the pin 100 is engaged, for example, with the limit stop 96, the rotary valve member 54 is disposed at its rotary position which permits the VENTING stage of the combustion cycle to be performed, while when the rotary valve member 54 has been rotated such that the pin 100 is engaged, for example, with the limit stop 98, the rotary valve member 54 is disposed at its rotary position which permits the FIRING stage of the combustion cycle to be performed. Similarly, when the rotary valve member 54 has been rotated such that the pin 100 is disposed at a position intermediate the limit stops 96,98, the rotary valve member 54 is disposed at its rotary position which permits the MIXING stage of the combustion cycle to be performed.

Having described the primary structural components of the dual-chamber combustion system 10, the operation of the rotary valve member 54 in conjunction with the dual-chamber combustion system 10 for achieving the aforenoted VENTING, MIXING, and FIRING stages of the combustion cycle will now be described. After the fastener-driving tool has been fired so as to drive a fastener into a workpiece or substrate, the trigger mechanism of the tool is deactuated or released and the fastener-driving tool is removed from its engaged contact with the workpiece or substrate whereby the rotary valve mechanism 54 is automatically rotated back to its first position, as a result of being operatively connected to particular components of the fastener-driving tool, not shown, at which VENTING, PURGING, or SCAVENGING of the combustion chambers 12,14 can be achieved. It is noted, as can best be appreciated from FIG. 2, that the apertures 58 defining the intake ports 28, as defined within the combustion chamber body member 44, are located along a vertical linear locus which is effectively circumferentially offset by a predetermined amount from the vertical linear locus along which the apertures 80 are located, and similarly, of course, for the apertures 59,81 as defined within the tubular casing or housing member 56. Still yet further, and in a likewise similar manner, the left edge portion 72 of the first plenum chamber 20, as defined upon the rotary valve member 54, is circumferentially offset with respect to the through-bores 78 defined within the rotary valve member 54 as can be appreciated from FIGS. 6 and 8.

Figure 5:
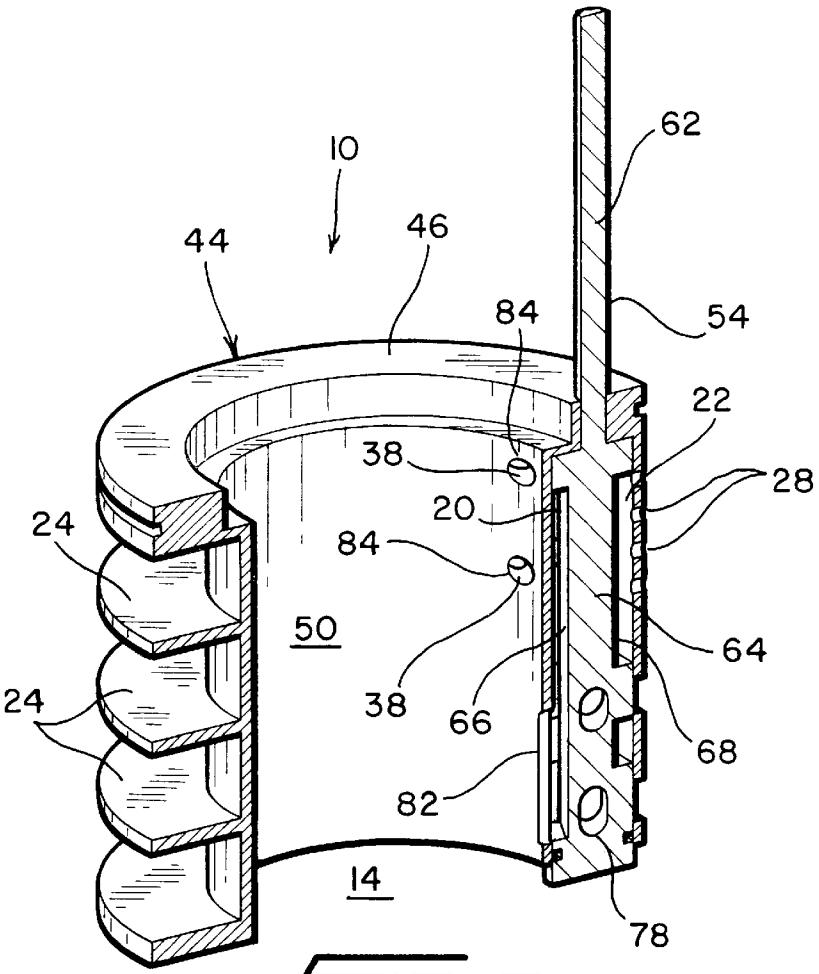
FIG. 5 is a cross-sectional view of the combustion chamber body member illustrated within FIG. 2, as taken along the lines 5—5 of FIG. 2, and additionally illustrating the rotary valve mechanism as rotatably disposed within the combustion chamber body member.
Figure 9:
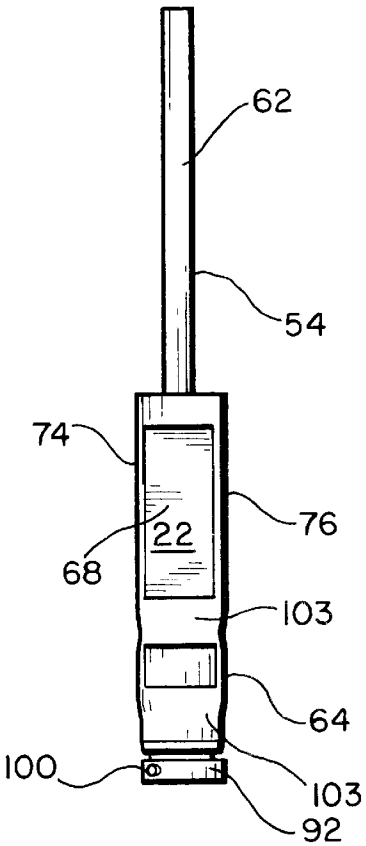
FIG. 9 is a side elevational view similar to that of FIG. 6 illustrating the second plenum chamber as defined upon the second side portion of the rotary valve mechanism as illustrated within FIGS. 6–8.

Accordingly, when the rotary valve mechanism 54 is disposed at its first position such that the through-bores 78 defined within the rotary valve member 54 are fluidically aligned with the apertures 82,80,81 so as to effectively define exhaust paths out from the interior of the second combustion chamber 14, the vertically oriented right edge portion 72 of the first plenum chamber 20 will be substantially aligned with the right edge portions of the apertures 58 defined within the combustion chamber body member 44, as well as with the vertically oriented right edge portion 102 of the aperture 59 formed within the combustion chamber tubular casing or housing member 56. In this manner, the first plenum chamber 20 will effectively be opened or exposed to atmospheric air which can now enter the intake ports 28, traverse the first plenum chamber 20, and be fluidically conducted through the passageways 26 into the various segments 12*a*,12*b*,12*c*,12*d* of the first combustion chamber 12. After traversing the segments 12*a*,12*b*,12*c*,12*d* of the first combustion chamber 12, the incoming fresh, purging, or scavenging air is conducted through the passageways 36, not visible in FIG. 2 but formed within the right side portion of the rotary valve housing 52, and through passageways 38 which are fluidically connected to the fan-suction side of the interior of the second combustion chamber 14 as seen in FIG. 5. Operation of the fan 32 within the upper end portion of the second combustion chamber 14 facilitates the flow of the purging or scavenging air throughout the system 10, and as has been noted, since aperture 82 is, at this time, fluidically connected to the through-bores 78 defined within the rotary valve member 54, and since the through-bores 78 are, in turn, fluidically connected to the apertures 80 formed within the tubular rotary valve housing 52, and the apertures 81 formed within the combustion chamber tubular casing or housing member 56, the purging or scavenging air circulated throughout the first and second combustion chambers 12,14 is able to be exhausted into the atmosphere. It is of course to be appreciated that a suitable cover, not shown for clarity purposes, is adapted to be disposed atop the combustion chamber body member 44 so as to otherwise seal off, for example, second combustion chamber 14 from the atmosphere.

Subsequently, when the fastener-driving tool is to be used to drive a fastener into a workpiece or substrate, the nosepiece portion of the fastener-driving tool is forced into contact with the workpiece or substrate whereby, as a result of an operative connection, not shown, between the nosepiece portion of the tool and the rotary valve member 54, the rotary valve member 54 is rotated in a clockwise direction to its second intermediate position so as to permit the MIXING stage of the combustion cycle to proceed. As a result of the disposition of the rotary valve member 54 at its intermediate position, the through-bores 78 of the rotary valve member 54 are no longer fluidically aligned with and connected to the exhaust apertures 80,81 respectively defined within the tubular rotary valve housing 52 and the combustion chamber tubular casing or housing member 56. In particular, solid sections 103 of the rotary valve shank or body portion 64, disposed beneath the recessed section 68 defining the second plenum chamber 22, are aligned with the apertures 80 defined within the tubular rotary valve housing 52, and consequently, the exhaust ports 34 are closed.

Figure 8:
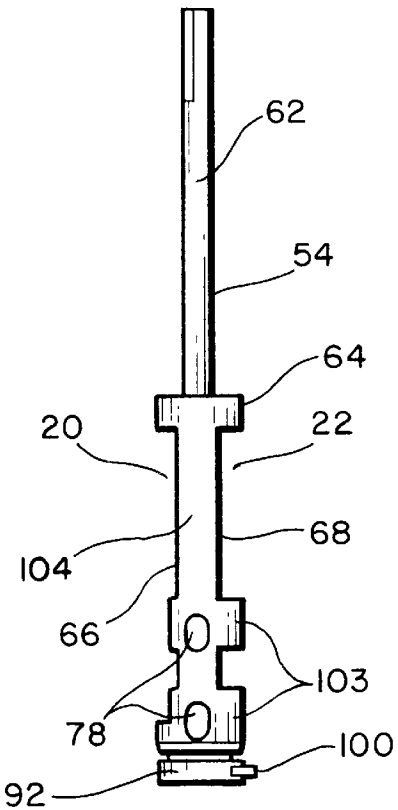
FIG. 8 is an end elevational view of the rotary valve mechanism as illustrated within FIGS. 6 and 7 and illustrating the disposition of the first and second plenum chambers as defined upon the first and second opposite sides of the rotary valve mechanism.
Figure 7:
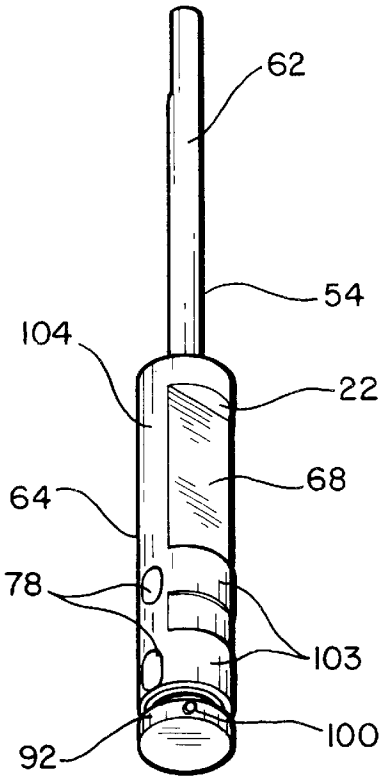
FIG. 7 is a perspective view of the rotary valve mechanism as illustrated within FIG. 6 and illustrating the second plenum chamber as defined upon a second side portion of the rotary valve mechanism.
Figure 6:
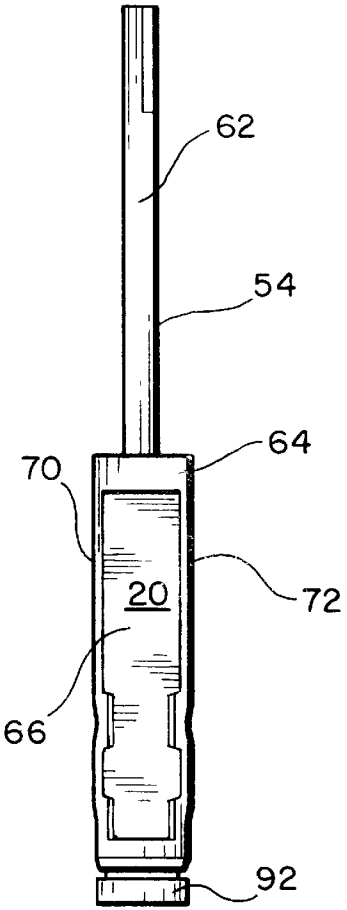
FIG. 6 is a first side elevational view of the rotary valve mechanism as partially illustrated within FIG. 5 and illustrating the first plenum chamber as defined upon a first side portion of the rotary valve mechanism.

In a similar manner, the solid section 104 of the rotary valve shank or body portion 64, which is defined between the recessed surfaces 66,68 defining the first and second plenum chambers 20,22, and which is also positioned above the through-bores 78 as best seen in FIG. 8, now blocks or closes off the apertures 58 defining the intake ports 28 within the tubular rotary valve housing 52 whereby fresh air is prevented from entering the first plenum chamber 20. At this point in time, fuel is also injected into the upstream end portion of the first combustion chamber 12, and more particularly, within the combustion chamber segment 12*a* by means of the fuel injector 40 as disclosed within FIGS. 1*a*–1*c* and 2, and accordingly, the air-fuel mixture is circulated through the first and second combustion chambers 12,14 under the influence of the fan 32. In particular, the air-fuel mixture traverses the first. combustion chamber segments 12*a*,12*b*,12*c*,12*d* and flows through the passageways 36 formed within the right side portion of the tubular rotary valve housing 52 so as to flow through the second plenum chamber 22. From the second plenum chamber 22, the air-fuel mixture flows through the apertures 84 defining the passageways 38, as seen in FIG. 5, and enters the upper fan-suction side of the second combustion chamber 14. As a result of the clockwise rotation of the rotary valve member 54, it is noted that the left edge portion 70 of the first plenum chamber 20 is now disposed at a substantially central region of the aperture 82 formed within the interior wall portion 50 of the second combustion chamber 14 such that the lower portion of the first plenum chamber 20 is fluidically connected to the interior of the second combustion chamber 14. Accordingly, the air-fuel mixture flows downwardly within the second combustion chamber 14, enters the aperture 82, which effectively defines the fluid passageway 30, flows upwardly within the first plenum chamber 20, and passes through the passageways 26 so as to again re-enter and traverse the segments 12*a*,12*b*,12*c*,12*d* of the first combustion chamber 12 whereby recirculation of the air-fuel mixture through the first and second combustion chambers 12,14 is achieved so as to in turn achieve the desired MIXING of the air and fuel mixture components throughout the first and second combustion chambers 12,14.

After a suitable period of time for completing the MIXING stage of the combustion cycle, the fastener-driving tool is ready to be fired so as to in fact drive a fastener into a workpiece or substrate. The trigger mechanism of the tool is operatively connected to the rotary valve member 54, and as a result of the actuation of the tool trigger mechanism, the rotary valve member 54 is rotated further in the clockwise direction to its third position at which the FIRING stage of the combustion cycle can be performed. Accordingly, when the rotary valve member 54 is rotated to its third position at which the FIRING stage of the combustion cycle can be performed, the rotary valve member 54 will be disposed as disclosed, for example, within FIG. 5. More particularly, it is seen that the through-bores 78 are not aligned with the apertures 82,80,81 respectively defined within the inner peripheral wall surface 50 of the combustion chamber body member 44, the tubular rotary valve housing 52, and the combustion chamber tubular casing or housing member 56, and in addition, the solid portions 103,103 of the rotary valve member 54, which are disposed beneath the second plenum chamber 22, also block or close off the apertures 80,81 respectively defined within the tubular rotary valve housing 52 and the combustion chamber tubular casing or housing member 56. In this manner, combustion products from the second combustion chamber 14 cannot be exhausted through means of the apertures 82,80,81.

In addition, it is to be appreciated that while the second plenum chamber 22 is fluidically connected or exposed to the intake ports 28, the solid side portions 104 of the rotary valve shank or body portion 64, as defined upon opposite sides of the rotary valve shank or body portion 64 between the recessed surfaces 66,68, are now disposed at positions which respectively block or close off the fluid passageways 26 which are defined within the left side portion of the tubular rotary valve housing 52 and which lead into the first combustion chamber segments 12*a*,12*b*,12*c*,12*d*, as well as the fluid passageways 36 which are defined within the right side portion of the tubular rotary valve housing 52 and which are adapted to be fluidically connected to the interior of the second combustion chamber 14 through means of the fluid passageways 38.

Accordingly, as can be readily appreciated from the schematic view illustrated within FIG. 1*c*, the first and second combustion chambers 12,14 are now effectively isolated from each other except through means of the one-way check-valve 18 and the fluid passageway 16. More particularly, when the FIRING stage of the combustion cycle is initiated by means of the tool trigger mechanism whereby ignition within the first combustion chamber 12 by means of, for example, the spark plug 42 as is also shown in FIG. 2, the flame front generated by means of such ignition traverses the segments 12*a*,12*b*,12*c*,12*d* of the first combustion chamber 12, as can be appreciated from FIGS. 1*c* and 2, and exits from the downstream end of the first combustion chamber segment 12*d* through means of an exhaust port or orifice 106 which can be controlled by means of the one-way check valve 18. When the flame front passes through exhaust port 106, as permitted by means of the one-way check valve 18 if the one-way check valve 18 is being utilized, the flame front enters the lower end portion of the second combustion chamber 14 through means of an arcuately-shaped port 108 which effectively defines the fluid passageway 16 as is shown in FIG. 1*c*, which is defined within the combustion chamber base member 86, as shown in FIG. 4, and which is fluidically connected to the exhaust port 106. The combustion chamber base member 86 additionally comprises a substantially annular platform section 110 upon which the lower end portion of the combustion chamber body member 44 is adapted to be seated, and it is also appreciated that the platform section 110 is elevated above lower end portion of the base member 86 as defined, for example, by means of the flanged portion 88. In this manner, the fluid passageway 16 effectively extends diametrically beneath a central portion 112 of the platform section 110 so as to be fluidically connected throughout the entire diametrical extent or expanse of the lower end portion of the second combustion chamber 14. Accordingly, combustion is generated within the second combustion chamber 14 whereby the generated energy and power can impact upon a suitable fastener piston-driver assembly, not shown, disposed within the fastener-driving tool. It can thus be seen that by means of the single rotary valve mechanism 10 constructed in accordance with the principles and teachings of the present invention, all three of the VENTING, MIXING, and FIRING stages of the combustion cycle can be suitably facilitated and controlled.

With reference now being made to FIGS. 10–16, a second embodiment of a dual combustion chamber system, as is also constructed in accordance with the teachings and principles of the present invention, is disclosed and is generally indicated by the reference character 210. It will be appreciated that the second embodiment of the dual combustion chamber system 210 is significantly different from the first embodiment of the dual combustion chamber system 10, as disclosed within FIGS. 2–9, in that in lieu of the incorporation of a rotary control valve mechanism within the first embodiment of the dual combustion chamber system 10, the second embodiment of the dual combustion chamber system 210 has a combination linear-rotary control valve mechanism incorporated therein. In addition, it is noted that in lieu of the provision or disposition of a separate control valve component, such as, for example, the valve member 54 within the combustion chamber system 10, the various integrated structural components of the dual combustion chamber system 210 effectively define the valving structure of the second embodiment of the dual combustion chamber system 210. It is also noted that while the dual combustion chamber system 210 has a single valving mechanism effectively incorporated therein for facilitating the achievement of the aforenoted VENTING, MIXING, and FIRING stages of the combustion cycle, the actual fluid flow directions, characteristic of one or more of such stages of the combustion cycle, may be somewhat different than those characteristic of the dual combustion chamber system 10 as disclosed within FIGS. 2–9 as well as those schematically illustrated within FIGS. 1*a*–1*c*.

Figure 10:
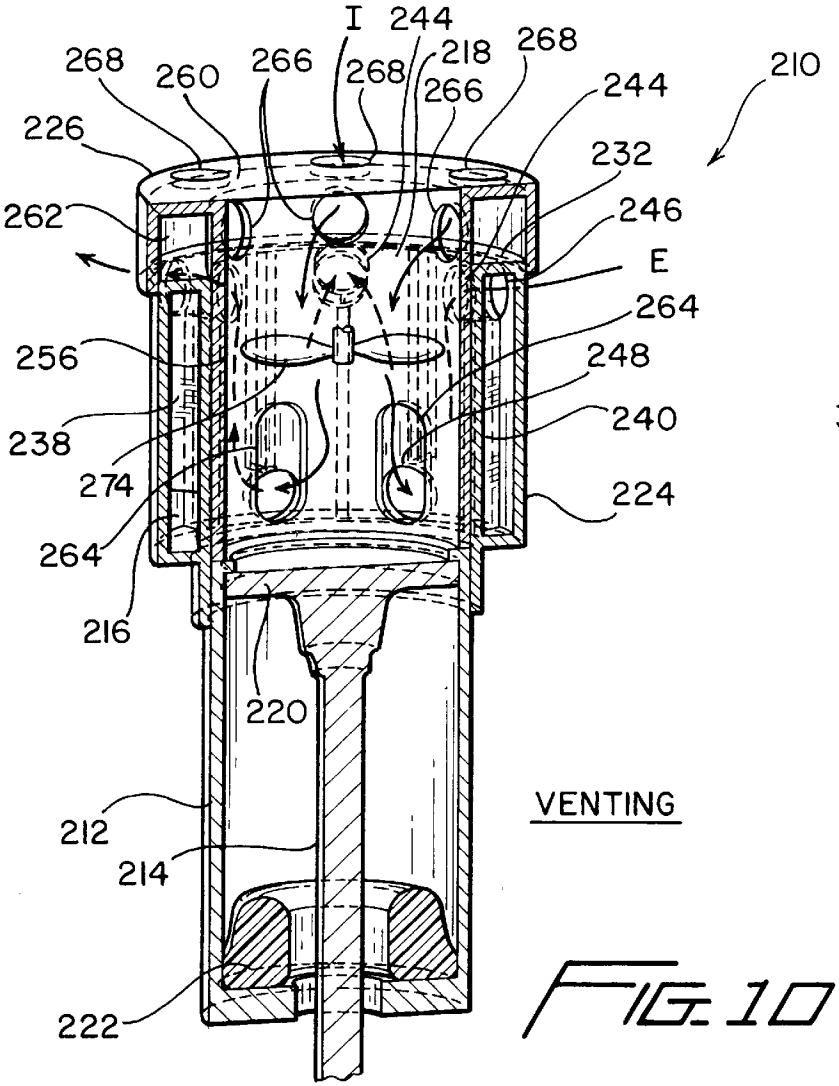
FIG. 10 is a cross-sectional view of a second embodiment of a dual combustion chamber system, constructed in accordance with the principles and teachings of the present invention, comprising first and second valve housings or components which respectively define a first peripherally outer combustion chamber having a sinusoidal or convoluted configuration, and a second centrally located cylindrical combustion chamber which is annularly surrounded by means of the first peripherally outer combustion chamber, and wherein further, the first and second valve housings or components are linearly and rotatably movable with respect to each other so as to achieve three separate and distinct positions in order to facilitate the operation of the VENTING, MIXING, and FIRING stages of the combustion cycle, the first and second valve housings or components being disposed at their first relative positions for achieving the VENTING stage of the combustion cycle.
Figure 12:
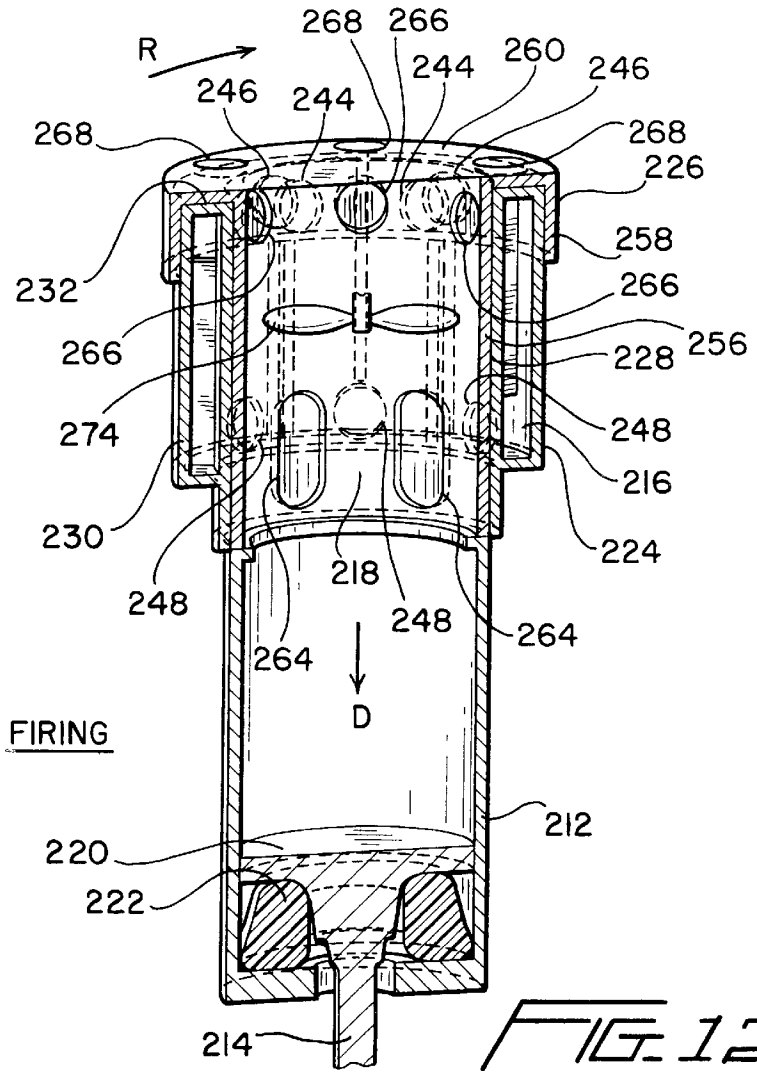
FIG. 12 is a view similar to that of FIGS. 10 and 11 showing, however, the disposition of the valve housings or components at their third positions so as to achieve the FIRING stage of the combustion cycle.
Figure 11:
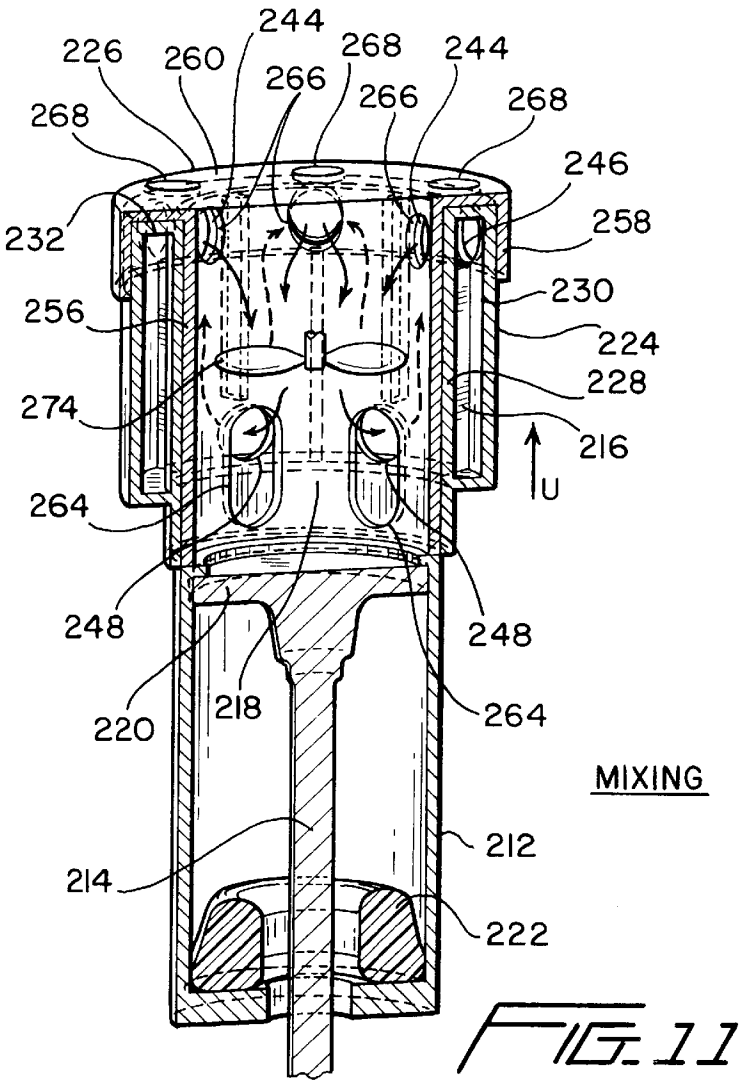
FIG. 11 is a view similar to that of FIG. 10 showing, however, the disposition of the valve housings or components at their second positions so as to achieve the MIXING stage of the combustion cycle.

It may also be readily appreciated, as best illustrated within FIGS. 10–12, how the dual combustion chamber system 210 of the present invention is operatively associated with the various structural components of the fastener-driving tool which are actually utilized in connection with the driving of a fastener out of the fastener-driving tool and into a workpiece or substrate. More particularly, a tool cylinder 212 has a piston-driver assembly 214 movably disposed therein, and the first and second combustion chambers are respectively disclosed at 216 and 218 wherein, again, it is seen that the first combustion chamber 216 annularly surrounds the second combustion chamber 218. Accordingly, as combustion is generated within the first and second combustion chambers 216,218, the energy and power developed by means of such combustion impacts upon the piston head portion 220 of the piston-driver assembly 214 thereby driving the piston-driver assembly 214 downwardly as denoted by means of the arrow D whereby the piston-driver assembly 214 can drive a fastener, not shown, out from the fastener-driving tool and into a workpiece or substrate. A bumper member 222 is disposed within the lower or downstream end portion of the cylinder 212, as is conventional, so as to permit the piston head portion 220 of the piston-driver assembly 214 to impact thereon in a shock-absorbing manner when the piston-driver assembly 214 reaches the end of its power or driving stroke.

Figure 14:
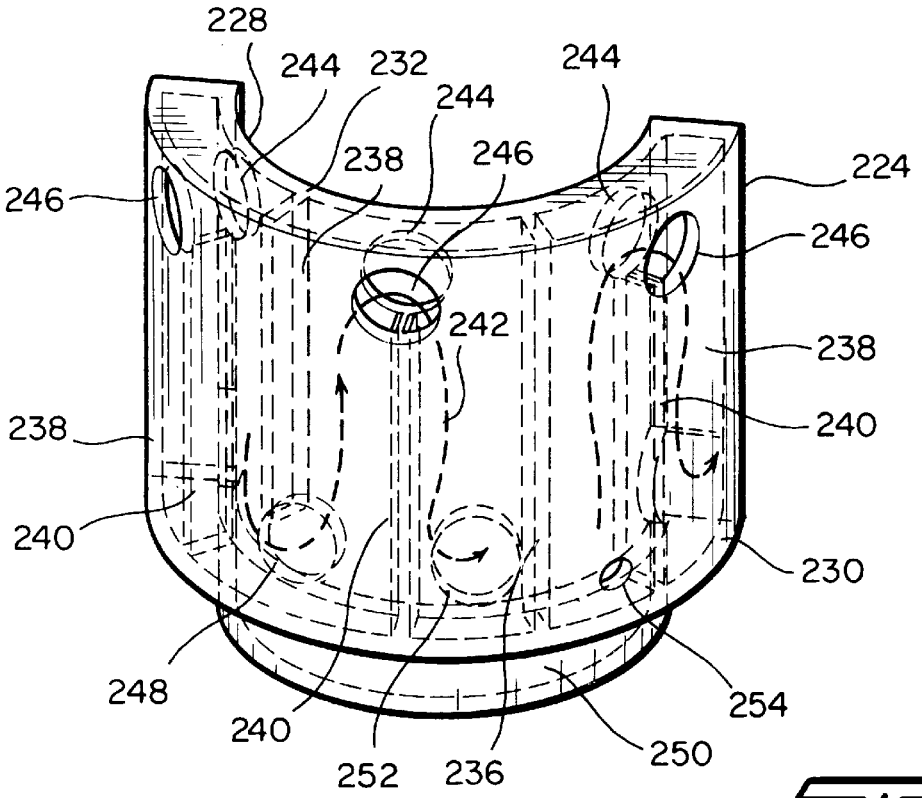
FIG. 14 is a rear perspective view of the first valve housing or component of the dual combustion chamber system as illustrated within FIG. 13.
Figure 13:
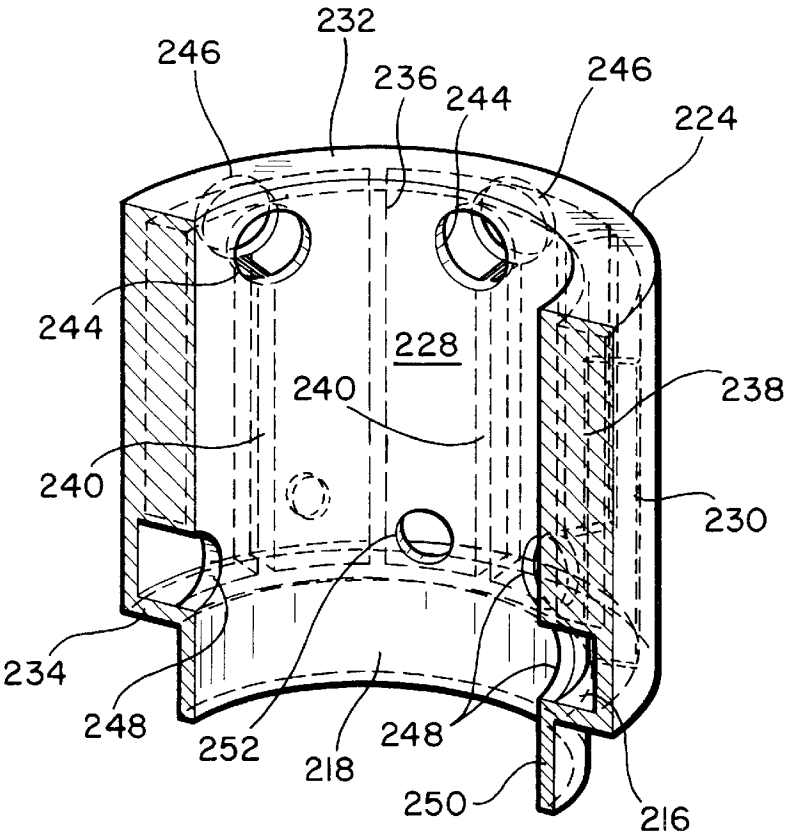
FIG. 13 is a front perspective view, partly in cross-section, of the first valve housing or component of the dual combustion chamber system as illustrated within FIGS. 10–12.

As can also be appreciated as a result of additional reference being made to FIGS. 13–16, it is noted that the first combustion chamber 216 is defined within a first combustion chamber housing 224, while the second combustion chamber 218 is defined within the central portion of a second combustion chamber housing 226. The second combustion chamber housing 226 is fixedly mounted atop the cylinder 212, however, as will become more apparent hereinafter, the first combustion chamber housing 224 is adapted to be both linearly and rotatably movable with respect to the fixed second combustion chamber housing 226. With reference therefore being made first to FIGS. 13–16, the details of the first and second combustion chamber housings 224,226 will now be described. More particularly, as best seen in FIGS. 13 and 14, the first combustion chamber housing 224 is seen to comprise an annular structure which is defined by means of an inner peripheral wall member 228, an outer peripheral wall member 230 which is radially separated from the inner peripheral wall member 228, an upper wall member 232, and a lower wall member 234. The wall members 228,230, 232,234 together define an annular space which serves as the first combustion chamber 216, and as can best be seen from FIGS. 10–12, the first combustion chamber 216 is seen to have a substantially rectangular cross-sectional configuration. As best seen in FIGS. 13 and 14, a vertically oriented wall member or partition 236 is integrally connected to the upper and lower wall members 232,234, and in this manner, the wall member or partition 236 effectively fluidically separates the upstream and downstream ends of the first combustion chamber 216 from each other.

It is further seen that a plurality of circumferentially spaced wall members 238 are integrally connected at their upper end portions to the upper wall member 232 while their lower end portions are spaced above the lower wall member 234, and in a similar manner, a plurality of circumferentially spaced wall members 240 are integrally connected at their lower end portions to the lower wall member 234 while their upper end portions are spaced below the upper wall member 232. The wall members 238,240 are also disposed in an alternative manner with respect to each other within the first combustion chamber 216, and in this manner, as is schematically illustrated at 242 within FIG. 14, a sinusoidal or serpentine fluid flow is defined within the first combustion chamber 216. As can best be appreciated further from both FIGS. 13 and 14, a plurality of circumferentially spaced apertures 244 are defined within upper regions of the inner peripheral wall member 228 of the first combustion chamber housing 224, and a plurality of circumferentially spaced apertures 246 are defined within upper regions of the outer peripheral wall member 230 of the first combustion chamber housing 224, wherein the apertures 244, 246 comprising each set of apertures 244,246 are coaxially aligned with respect to each other.

In a similar manner, a plurality of circumferentially spaced apertures 248 are defined within lower regions of the inner peripheral wall member 228 of the first combustion chamber housing 224, and a dependent wall or skirt portion 250 extends downwardly from, and as an integral extension of, the interior wall portion 228 of the first combustion chamber housing 224 beneath the apertures 248. Still further, a single exhaust port 252 is defined within a lower region of the inner peripheral wall member 228 of the first combustion chamber housing 224, at a circumferential position which substantially corresponds to the downstream end portion of the first combustion chamber 216 and which is located adjacent to the partition wall member 236, so as to fluidically interconnect the first combustion chamber 216 to the second combustion chamber 218 and thereby permit combustion products, and the combustion flame front, to proceed from the first combustion chamber 216 into the second combustion chamber 218. Lastly, in order to initiate combustion within the first combustion chamber 216, the spark plug 42, as schematically illustrated within FIGS. 1*a*–1*c*, is adapted to be mounted within a spark plug port 254 which is defined within a lower region of the outer peripheral wall member 230 of the first combustion chamber housing 224 at a circumferential position which is adjacent to the partition wall member 236 and which corresponds to the upstream end portion of the first combustion chamber 216.

Figure 16:
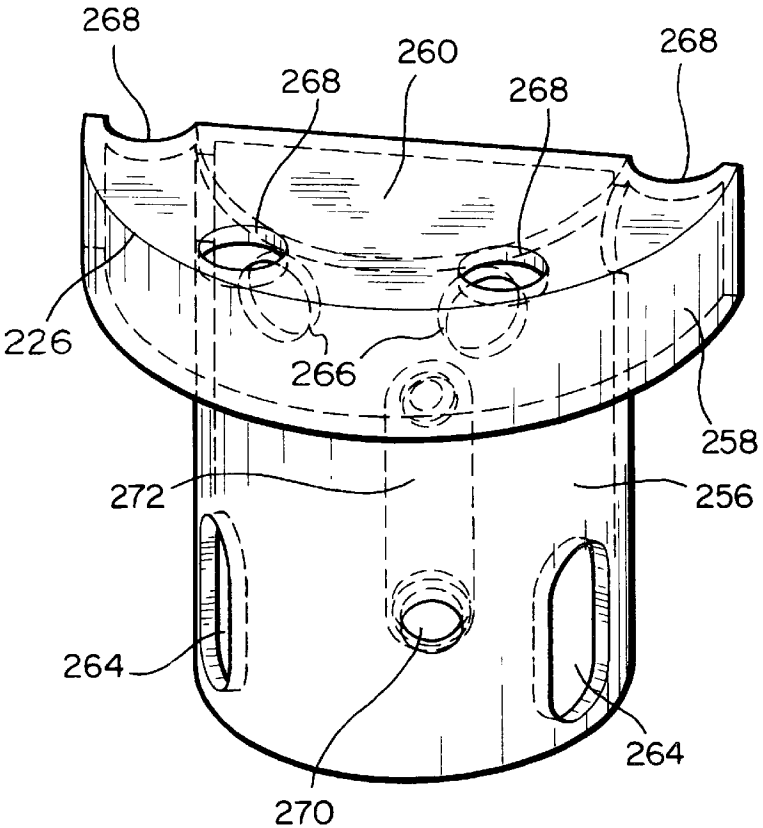
FIG. 16 is a rear perspective view of the second valve housing or component of the dual combustion chamber system as illustrated within FIG. 15.
Figure 15:
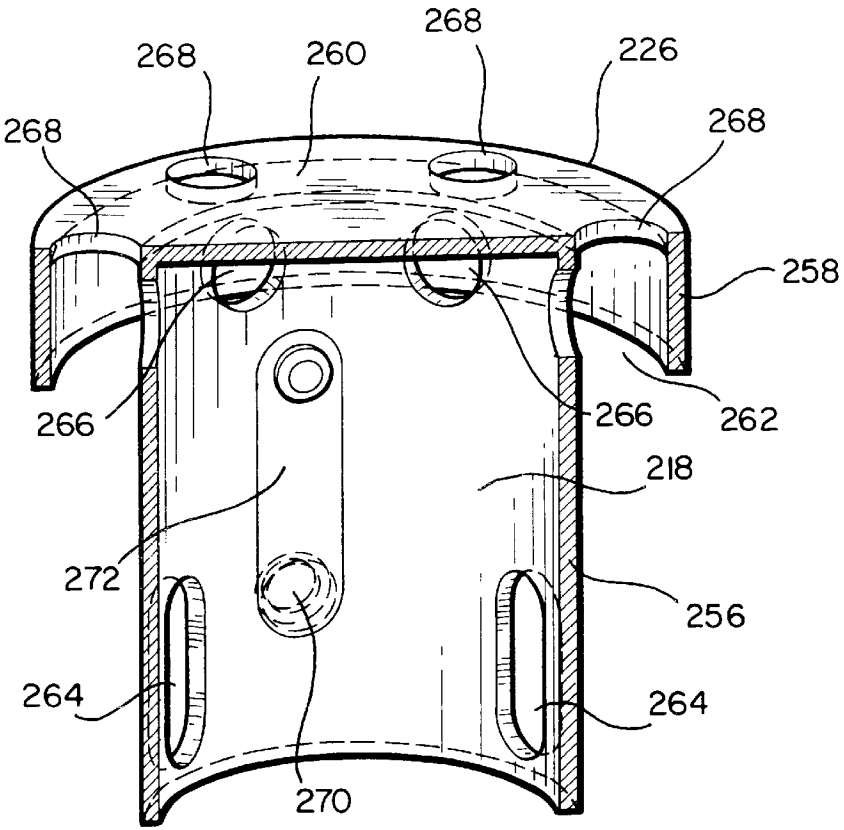
FIG. 15 is a front perspective view, partly in cross-section, of the second valve housing or component of the dual combustion chamber system as illustrated within FIGS. 10–12.

Turning now to FIGS. 15 and 16, the details of the fixed second combustion chamber housing 226 will now be described. More particularly, it is seen that the second combustion chamber housing 226 comprises a first radially inner annular wall member 256 within which the second combustion chamber 218 is defined, and wherein the lower end portion thereof is adapted to be fixedly seated upon the upper end portion of the tool cylinder 212 as may best be appreciated from FIGS. 10–12. A second radially outer annular wall member 258 is fixed at its upper end portion to a peripheral portion of an upper wall member 260 which covers the upper end of the second combustion chamber 218 and which projects radially outwardly beyond the inner annular wall member 256, and in this manner, the second radially outer annular wall member 258 is radially spaced from the first radially inner annular wall member 256 so as to define a chamber 262. Since the second radially outer annular wall member 258 effectively has the form of a dependent skirt, the bottom region of chamber 262 is structurally open, however, when the second combustion chamber housing 226 is operatively assembled with the first combustion chamber housing 224, as can be appreciated from FIGS. 10–12, the upper wall member 232 of the first combustion chamber housing 224 effectively closes the bottom region of chamber 262. More particularly, the upper wall member 232 of the first combustion chamber housing 224, the radially outer annular wall member 258 of the second combustion chamber housing 226, the upper region of radially inner annular wall member 256 of the second combustion chamber housing 226, and upper wall member 260 of the second combustion chamber housing 226 cooperate together so as to render chamber 262 an enclosed annular chamber. Continuing further, a plurality of circumferentially spaced elongated apertures 264 are defined within lower regions of the radially inner annular wall member 256 of the second combustion chamber housing 226, a plurality of circumferentially spaced apertures 266 are defined within upper regions of the radially inner annular wall member 256 of the second combustion chamber housing 226, and a plurality of circumferentially spaced air intake ports 268 are defined within outer peripheral regions of the upper wall member 260 of the second combustion chamber housing 226 so as to be disposed in fluidic communication with the annular chamber 262. Lastly, a combustion or flame inlet port 270 is defined at a predetermined circumferential position within the lower region of radially inner annular wall member 256 so as to receive combustion products and the flame front from the outlet port 252 defined within the first combustion chamber housing 224, and as seen in FIG. 15, a one-way check valve 272 is mounted upon the interior wall surface of the radially inner annular wall member 256 so as to control the propagation of the combustion products and the flame front from the first combustion chamber 216 into the second combustion chamber 218.

Having described the various structural components of the dual combustion chamber system 210, the operation of the dual combustion chamber system 210, in connection with the achievement of the various VENTING, MIXING, and FIRING stages of the combustion cycle, will now be described as a result of additional reference being made to FIGS. 10–12. Accordingly, after a fastener has been fired by the fastener-driving tool, and the tool trigger mechanism has been released or deacted, and the fastener-driving tool has been disengaged out of contact with the workpiece or substrate, the first and second combustion chamber housings 224,226 will be disposed at their relative VENTING positions as disclosed within FIG. 10.

More particularly, the first combustion chamber housing 224 has been moved back to its vertically lowered position with respect to the second combustion chamber housing 226, and has also been moved back, in the counterclockwise direction, to its initial rotary position with respect to the second combustion chamber 226. Therefore, when the first and second combustion chamber housings 224, 226 are disposed at such relative positions with respect to each other, it is seen that the upper wall member 232 of the first combustion chamber housing 224 operatively cooperates with the lower end dependent portion of the second radially outer annular wall member 258 of the second combustion chamber housing 226 so as to close off the bottom region of the annular chamber 262. In addition, it is seen that the apertures 248, defined within the lower portions of the inner peripheral wall member 228 of the first combustion chamber housing 224, are fluidically connected with the elongated apertures 264 defined within the lower portions of the inner peripheral wall member 256 of the second combustion chamber housing 226. Accordingly, fresh atmospheric intake air I is able to enter the dual combustion chamber system 210 through means of the apertures 268 defined within the upper wall member 260 of the second combustion chamber housing 226 whereby such air enters the annular chamber 262. The air flow is then permitted to enter the upper region or suction side of the second combustion chamber 218, under the influence of the rotary fan member 274, through means of the apertures 266 defined within the upper regions of the radially inner peripheral wall member 256 of the second combustion chamber 218, and subsequently, the air flow will be able to flow through the aforenoted fluidically connected apertures 248,264 so as to enter the various sinusoidal or serpentine flow paths defined within the first combustion chamber 216. Ultimately, such air flow can be exhausted from the first combustion chamber 216 through means of the apertures 246 defined within the radially outer peripheral wall member 230 as indicated by the arrows E.

Subsequently, when, for example, the nosepiece portion of the fastener-driving tool is disposed in contact with the workpiece or substrate into which a fastener is to be driven in preparation for initiating a fastener-driving operation, the first combustion chamber housing 224 is moved linearly upwardly with respect to the second combustion chamber housing 226 to the position illustrated within FIG. 11, as indicated by the arrow U, at which position MIXING of the air-fuel mixture throughout the first and second combustion chambers 216,218 can be performed. More particularly, as can be appreciated from FIG. 11, it is seen that the annular chamber 262 is totally collapsed such that the upper wall member 232 of the first combustion chamber housing 224 is now disposed in contact with the undersurface portion of the upper wall member 260 of the second combustion chamber housing 226 whereby the fresh air intake ports 268, defined within the upper wall member 260 of the second combustion chamber housing 226, are now blocked or closed.

In a similar manner, the exhaust ports 246, as defined within the upper regions of the outer peripheral wall member 230 of the first combustion chamber housing 224, are now covered and blocked by means of the second radially outer annular wall member 258 of the second combustion chamber housing 226, however the apertures 244 of the first combustion chamber housing 224 are now coaxially aligned with the apertures 266 of the second combustion chamber housing 226. Accordingly, after fuel has been injected into the upstream end of the first combustion chamber 216 by suitable means, not shown, similar to fuel injector 40 as disclosed within FIGS. 1*a*–1*c* and 2, the air-fuel mixture, under the influence of the fan member 274, is circulated within the first and second combustion chambers 216,218 from the suction side of the fan member 274, through the second combustion chamber 218, through the apertures 264,248 respectively defined within the radially inner peripheral wall members 256,228 of the first and second combustion chamber housings 226,224, into and through the various serpentine-configured segments of the first combustion chamber 216, and back out into the upstream or suction-side region of the second combustion chamber 218 through means of the aligned apertures 244,266 respectively defined upon the radially inner peripheral wall members 228,256 of the first and second combustion chamber housings 224,226. Lastly, when the fastener-driving tool is to be fired so as to in fact drive and discharge a fastener out from the fastener-driving tool and into a workpiece or substrate, the trigger mechanism, not shown, of the fastener-driving tool is actuated whereupon, as a result of an operative connection, also now shown, between the trigger mechanism and the first combustion chamber housing 224, the first combustion chamber housing 224 is rotated in the clockwise direction with respect to the second combustion chamber housing 226 to the position illustrated within FIG. 12, as indicated by the arrow R, at which position the FIRING stage of the combustion cycle can be achieved.

More particularly, ignition is initiated within the first combustion chamber 216 by means of a spark plug or the like disposed at the spark plug port 254 as seen in FIG. 14, and as can be appreciated from FIG. 12, it is also seen that as a result of the aforenoted rotation of the first combustion chamber housing 224 with respect to the second combustion chamber housing 226, the apertures 244 of the first combustion chamber housing 224 are no longer coaxially aligned with the apertures 266 of the second combustion chamber housing 226, while similarly, the apertures 248 of the first combustion chamber housing 224 are likewise no longer aligned with or fluidically connected to the apertures 264 of the second combustion chamber housing 226. Accordingly, all fluid flow between the first and second combustion chambers 216 and 218 is now terminated except for the fluidic connection between the first and second combustion chambers 216,218 as permitted and controlled by means of first combustion chamber exhaust port 252, as seen in FIG. 13, the second combustion chamber inlet port 270 as seen in FIG. 16, and the one-way check valve 272 as seen in FIG. 15. Accordingly, the energy and power developed as a result of the combustion with the first and second combustion chambers 216,218 is able to be optimally delivered to the head portion 220 of the piston-driver assembly 214 whereby the same is driven downwardly in the direction D as illustrated within FIG. 12 so as to in fact drive and discharge a fastener from the fastener-driving tool.

Figure 17:
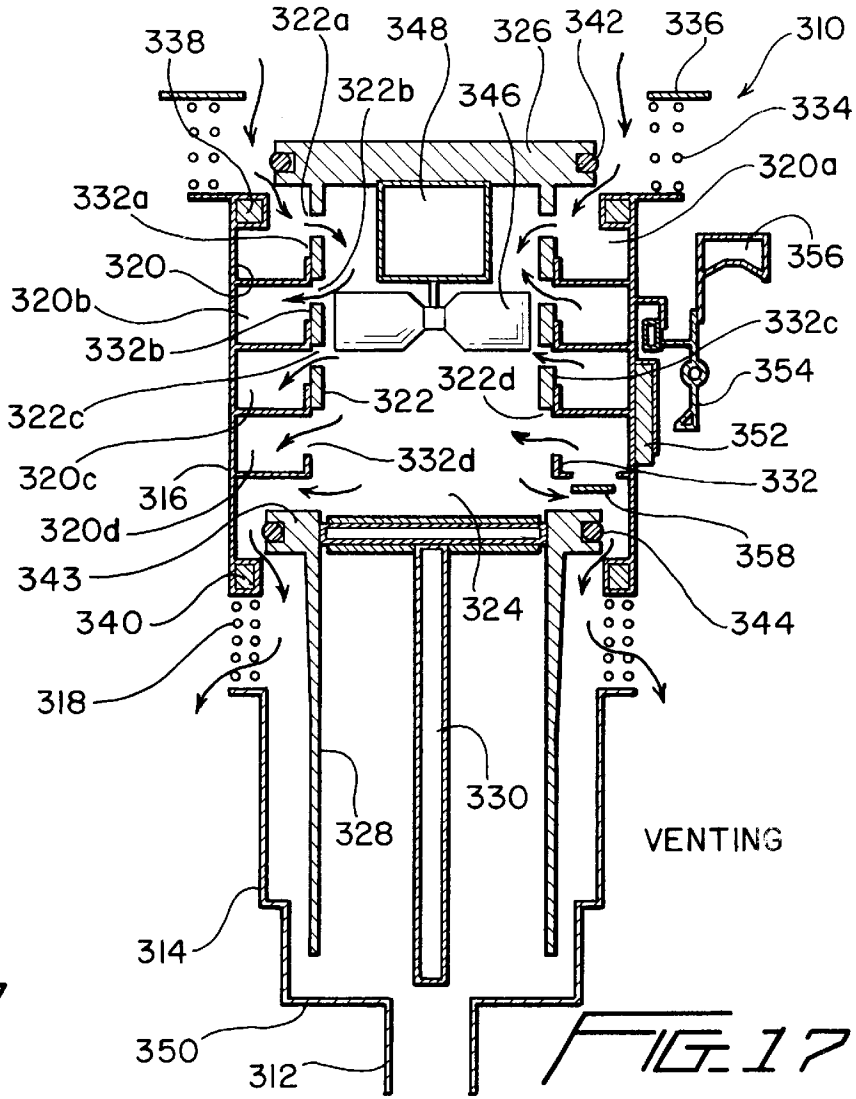
FIG. 17 is a schematic view illustrating the various operational components of a fastener-driving tool wherein the third linearly movable valve mechanism embodiment of the present invention is disposed at its first VENTING position.
Figure 19:
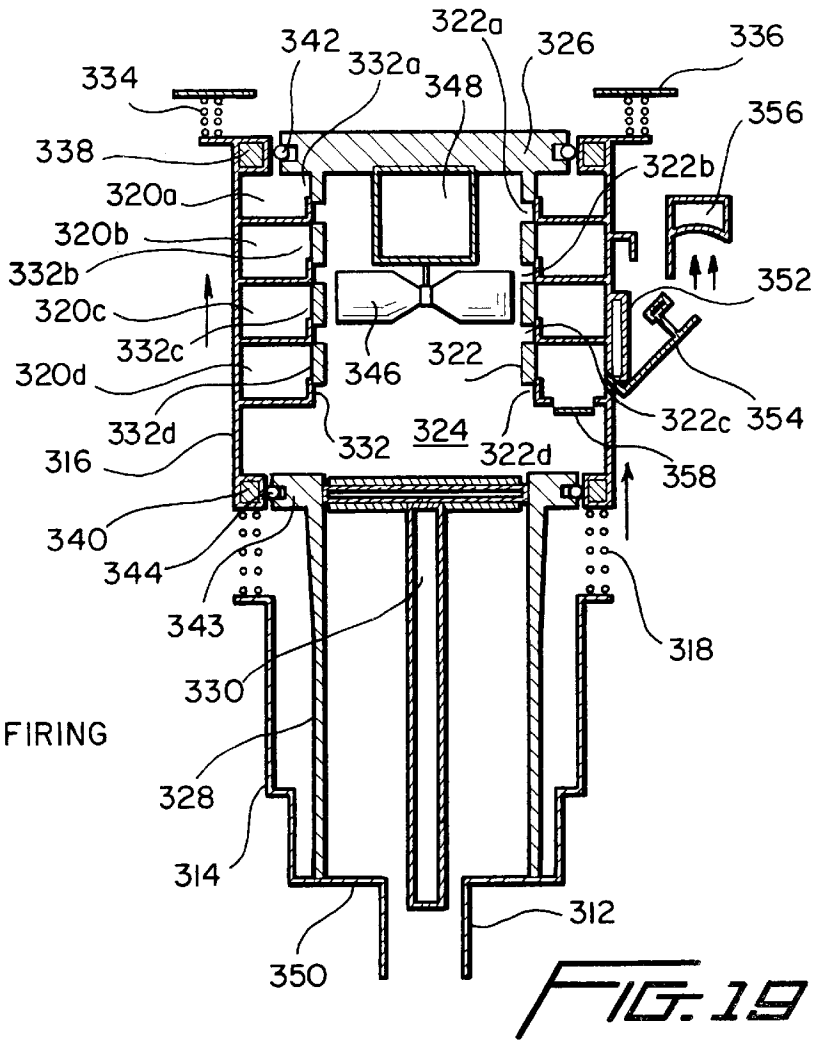
FIG. 19 is a schematic view similar to that of FIGS. 17 and 18 illustrating, however, the various operational components of a fastener-driving tool wherein the third linearly movable valve mechanism embodiment of the present invention is disposed at its third FIRING position.
Figure 18:
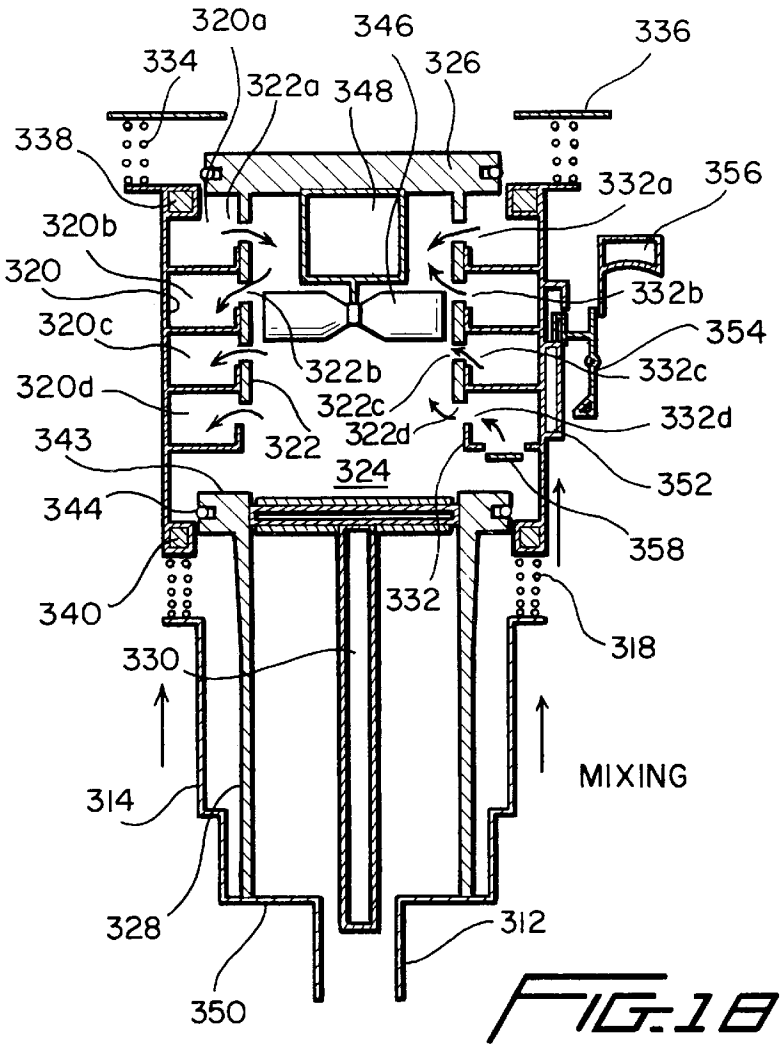
FIG. 18 is a schematic view similar to that of FIG. 17 illustrating, however, the various operational components of a fastener-driving tool wherein the third linearly movable valve mechanism embodiment of the present invention is disposed at its second MIXING position.

With reference now being lastly made to FIGS. 17–19, a third embodiment of a dual combustion chamber system, as is also constructed in accordance with the teachings and principles of the present invention, is disclosed and is generally indicated by the reference character 310. It will be appreciated that the third embodiment of the dual combustion chamber system 310 is significantly different from the first and second embodiments of the dual combustion chamber system 10,210 as disclosed within FIGS. 2–16, in that in lieu of the incorporation of the rotary control valve mechanism within the first embodiment of the dual combustion chamber system 10, or the incorporation of the combination linear-rotary control valve mechanism within the second embodiment of the dual combustion chamber system 210, the third embodiment of the dual combustion chamber system 310 comprises a solely linear control valve mechanism incorporated therein. In addition, it is noted that in lieu of the provision or disposition of the separate control valve component, such as, for example, the valve member 54 within the combustion chamber system 10, the various integrated structural components of the third embodiment of the dual combustion chamber system 310 are broadly similar to those of the second embodiment of the dual combustion chamber system 210 in that the same are effectively incorporated within the housing structure defining the third embodiment of the dual combustion chamber system 310. It is also noted that while the third embodiment of the dual combustion chamber system 310 does comprise a single valving mechanism effectively incorporated therein for facilitating the achievement of the aforenoted VENTING, MIXING, and FIRING stages of the combustion cycle, the actual structural components for achieving the fluid flow patterns, characteristic of one or more of the stages of the combustion cycle, may be somewhat different than those characteristic of the dual combustion chamber system 10 as disclosed within FIGS. 2–9 as well as those schematically illustrated within FIGS. 1*a*–1*c*.

With reference therefore now being made to FIGS. 17–19, it is seen that, in accordance with the third embodiment of the dual combustion chamber system 310 as constructed in accordance with the principles and teachings of the present invention, the fastener-driving tool, having the dual combustion chamber system 310 integrally incorporated therein, comprises an axially movable nosepiece or workpiece contact engaging member 312 which, as is well-known, effectively comprises a safety mechanism for permitting the tool to be enabled only when the tool is in fact firmly pressed against the workpiece or substrate into which a fastener is to be driven. The nosepiece or workpiece contact engaging member 312 is integrally connected to a lower, axially movable, external actuating mechanism 314, and a first axially movable, upper external annular housing section 316 is operatively connected to the lower actuating mechanism 314 through means of an annular actuating spring member 318. As will become more fully apparent hereinafter, the first annular housing section 316 not only effectively serves as the linearly movable valve mechanism characteristic of the third embodiment dual combustion chamber system 310 of the present invention, but in addition, the first annular housing section 316 serves to house the first combustion chamber 320 as defined by means of a plurality of first combustion chamber segments 320*a*,320*b*,320*c*,320*d* which are vertically stacked with respect to each other, and fluidically connected to each other in a substantially serpentine fashion, in a manner somewhat similar to the first combustion chamber segments 12*a*,12*b*,12*c*,12*d* of the first embodiment dual combustion chamber system 10 as disclosed, for example, within FIG. 2.

The first combustion chamber housing 316 is seen to annularly surround a second, radially inner fixed annular housing section 322 which effectively defines the second combustion chamber 324 therewithin. The second combustion chamber housing section 322 has a head member 326 fixedly mounted upon the upper or upstream end portion thereof, and the lower or downstream end portion of the second combustion chamber housing section 322 has an axially extending cylinder section 328 depending therefrom. A piston-driver assembly 330 is axially movable within the cylinder section 328 such that when combustion products, energy, and power are generated within the second combustion chamber 324, the piston-driver assembly 330 is moved axially downwardly so as to drive a fastener, not shown, out from the tool and into the workpiece or substrate. As can also be appreciated from FIGS. 17–19, the inner peripheral wall member 332 of the first combustion chamber housing section 316 is provided with a plurality of fluid passageways or ports 332*a*,332*b*, 332*c*,332*d*, and in a similar manner, the wall defining the second combustion chamber housing section 322 is likewise provided with a plurality of fluid passageways or ports 322*a*,322*b*,322*c*, as well as a fourth fluid passageway or port 322*d* which is effectively defined beneath the lower end portion of the second combustion chamber housing section wall 322.

With reference continuing to be made to FIGS. 17–19, the operation of the third embodiment of the dual combustion chamber system 310, as constructed in accordance with the principles and teachings of the present invention, and wherein the various VENTING, MIXING, and FIRING stages of the combustion cycle are accomplished by means of a solely linearly operable valve mechanism, will now be described. More particularly, at the conclusion of a FIRING stage of a combustion operation cycle whereby the tool, and the first and second combustion chambers 320 and 324 thereof, are disposed in a VENTING/EXHAUSTING stage of the combustion operation cycle, the various components of the dual combustion chamber system 310 will be disposed as depicted within FIG. 17. Accordingly, for example, as a result of the tool trigger mechanism having been released or deactuated, and as a result of the tool having been operatively disengaged from the workpiece or substrate, not shown, annular actuating coil spring member 318, along with an annular return spring member 334 which is interposed between the upper end portion of the first combustion chamber housing section 316 and a support plate or cover 336 of the tool, cause the nosepiece or workpiece contact engaging member 312, the lower, axially movable, external actuating mechanism 314, and the first axially movable, upper external annular housing section 316 to be moved to their lowermost positions as illustrated within FIG. 17. It is further seen that the upper and lower end portions of the first external housing section 316 are respectively provided with annular flanged members 338,340, and in a corresponding manner, the head member 326 of the second combustion chamber housing section 322 has an annular O-ring seal member 342 fixedly disposed therein, while the upper end portion 343 of the cylinder section 328, which effectively forms a bottom wall portion of the second combustion chamber 324, is likewise provided with an annular O-ring seal member 344. In addition, a circulating fan 346, driven by means of a suitable drive motor 348, is mounted within the upper or upstream end portion of the second combustion chamber 324.

Accordingly, it can be appreciated that VENTING air can enter the upper region of the tool through means of, for example, suitable apertures or the like, not shown, provided within the support plate or cover 336, or alternatively, laterally through the return spring member 334, and since the upper flanged portion 338 of the external housing section 316 is not axially aligned with, or is spaced from, the upper annular O-ring member 342, such VENTING air can enter the upper first combustion chamber segment 320*a* through means of the annular space defined between the upper flanged portion 338 of the housing section 316 and the head member 326. In addition, since the fluid passageways or ports 332*a*–332*d* of the inner wall member 332 of the first combustion chamber housing section 316 are effectively axially aligned with the fluid passageways or ports 322*a*–322*d* so as to be fluidically connected therewith, VENTING air can likewise be circulated, under the influence of circulating fan 346, through the first combustion chamber segments 320*a*–320*d*, as well as into the second combustion chamber 324 from the first combustion chamber segments 320–320*d*, and still further, into the first combustion chamber segments 320*a*–320*d* from the second combustion chamber 324 as denoted by means of the various fluid flow arrows. Ultimately, the VENTING air is exhausted from the lower or downstream end portion of the second combustion chamber 324 through means of the annular space, defined between the lower flanged portion 340 of the first combustion chamber housing section 316 and the upper end portion 343 of the cylinder section 328 within which the annular O-ring member 344 is disposed, and radially outwardly through means of actuating spring member 318.

Subsequently, and with reference now being made to FIG. 18, when the MIXING stage of the combustion cycle is to be initiated, the nosepiece or workpiece contact engaging element or member 312 is forced into contact with the workpiece or substrate, not shown, into which a fastener is to be driven, and accordingly, the nosepiece or workpiece contacting element or member 312, along with the actuating mechanism 314, is moved vertically upwardly relative to the tool cylinder section 328 and the piston-driver assembly 330 as can be appreciated from a comparison between FIGS. 17 and 18. Upward movement of the nosepiece or workpiece contacting element or member 312 and the actuating mechanism 314 is effectively arrested as a result of a transversely oriented wall portion 350 of the actuating mechanism 314 encountering the lower distal end portion of the tool cylinder section 328, as best seen in FIG. 18, however, such upward movement of the nosepiece or workpiece contacting element or member 312 and the actuating mechanism 314 also causes the actuating spring mechanism 318 to be axially compressed. As a result of such initial compression of the actuating spring mechanism 318, and a subsequent partial axial expansion of the same, the first combustion chamber housing section 316 is moved vertically upwardly, against the spring bias of the return spring mechanism 334, through means of a predetermined amount whereby, the first combustion chamber housing section 316 acting as a linear valve member, effectly causes the closure of the air intake ports as defined between the upper flanged portion 338 of the first combustion chamber housing section 316 and the head member 326, as well as the closure of the air exhaust ports as defined between the lower flanged portion 340 of the first combustion chamber housing section 316 and the upper end portion 343 of the tool cylinder section 328.

At this point in time, it is further noted that the vertically upward movement of the first combustion chamber housing section 316 is similarly arrested as a result of a stopper member 352, disposed upon the external wall surface of the first combustion chamber housing section 316 at a predetermined circumferential position thereof, encountering a latch mechanism 354 which is also operatively connected to the fastener tool trigger mechanism 356. Consequently, with the particular components or elements of the fastener tool, and more particularly, with the particular components or elements of the first and second combustion chambers 320, 324 being relatively disposed with respect to each other as illustrated within FIG. 18, it is further appreciated that all of the fluid passageways or ports 332*a*–332*d* of the inner wall member 332 of the first combustion chamber housing section 316 are still effectively axially aligned with the fluid passageways or ports 322*a*–322*d* of the wall member 322 defining the second combustion chamber 324. Accordingly, when fuel is injected into the upstream end portion of the first combustion chamber segment 320*a* by means of a suitable fuel injection port, not shown for clarity purposes, the MIXING phase or stage of the combustion cycle can readily occur between the injected fuel and the air present within the first and second combustion chambers 320,324 as a result of fluid flow between the first and second combustion chambers 320, 324, under the influence of the circulating fan 346, as again denoted by means of the fluid flow arrows.

Lastly, when the FIRING stage or phase of the combustion cycle is to be initiated, the fastener tool trigger mechanism 356 is actuated, and simultaneously therewith, the actuation of the trigger mechanism 356 causes the latch mechanism 354 to be moved to a released position so as to accordingly permit the stopper member 352 to be released from its previously arrested position whereby the first combustion chamber housing section 316 can now be vertically moved to its uppermost position, under the biasing influence of the actuating spring mechanism 318, as illustrated within FIG. 19. Concomitantly therewith, the air-fuel mixture, present within the first combustion chamber 320, is now ignited by means of, for example, a spark plug, not shown for clarity purposes, whereby ignition and flame front travel serially occurs throughout the segments 320*a*–320*d* of the first combustion chamber 320. It is to be particularly noted that the first combustion chamber housing section 316 again effectively serves as a linear valve member whereby, as can be readily appreciated from FIG. 19, the fluid passageways or ports 332*a*–332*d* defined within the inner wall member 332 of the first combustion chamber housing section 316 are no longer axially aligned with the fluid passageways or ports 322*a*–322*d* formed within the wall member 322 defining the second combustion chamber 324.

More particularly, non-apertured portions of the inner wall member 332 of the first combustion chamber housing section 316 effectively cover the fluid passageways or ports 322*a*–322*d* formed within the wall member 322 defining the second combustion chamber 324, while in a similar manner, non-apertured portions of the wall member 322 defining the second combustion chamber 324 effectively cover the fluid passageways or ports 332*a*–332*d* defined within the inner wall member 332 of the first combustion chamber housing section 316. In addition, it is also noted that as a result of the movement of the first combustion chamber housing section 316 to its uppermost position, the lower flanged portion 340 of the first combustion chamber housing section 316 now effectively forms a seal with the annular O-ring member 344 disposed within the upper end portion 343 of the tool cylinder section 328, while the upper flanged portion 338 of the first combustion chamber housing section 316 similarly forms a seal with the annular O-ring member 342 disposed within the head member 326. Accordingly, the combustion products generated within the first combustion chamber 320 can only be conveyed into the second combustion chamber 324 through means of the one-way check valve 358 which is provided within the downstream end portion of the first combustion chamber segment 320*d*. The power and energy subsequently developed or generated within the second combustion chamber 324 can therefore impact upon the piston-driver assembly 330 so as to in fact cause movement of the same for driving a fastener out from the fastener-driving tool and into the workpiece or substrate. Upon conclusion of the FIRING stage or phase of the combustion cycle, the trigger mechanism 356 is released, the fastener tool is disengaged from the workpiece or substrate so as to terminate contact between the nosepiece portion 312 of the tool with the workpiece or substrate, and the various operational components of the tool are returned to their original positions, as disclosed within FIG. 17, under the influence of, for example, spring mechanisms 334, 318, so as to initiate a new VENTING or EXHAUSTING stage or phase of the combustion cycle.

Thus, it may be seen that in accordance with either one of the first rotary, second linear-rotary, or third linear valving system embodiments of the present invention, there has been disclosed a single valve mechanism which is adapted to be successively moved to each one of three different positions for respectively achieving the VENTING, MIXING, and FIRING stages of the combustion cycle. In particular, the single valve mechanism facilitates and enhances the operational efficiency attendant the introduction and mixing of the air-fuel mixtures into and within the dual combustion chambers, as well as the operational efficiency attendant the scavenging and discharge of the combustion products out from the dual combustion chambers subsequent to the performance of the firing of the fastener-driving tool in connection with the driving and discharge of a fastener out from the fastener-driving tool and into a workpiece or substrate.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A valve assembly for use in conjunction with a dual combustion chamber system comprising first and second combustion chambers which are fluidically interconnected by means of a fluid port, comprising:

a valve mechanism;

a fresh air intake port defined within said valve mechanism for providing fresh air into the first and second combustion chambers so as to vent combustion products from the first and second combustion chambers following a FIRING stage of a combustion cycle;

an exhaust port defined within said valve mechanism for permitting the combustion products within the first and second combustion chambers to be exhausted from the first and second combustion chambers following said FIRING stage of said combustion cycle; and at least one fluid passageway operatively associated with said valve mechanism for fluidically interconnecting the first and second combustion chambers to each other during each of first, second, and third ones of three different positions of said valve mechanism for respectively achieving VENTING, MIXING, and FIRING stages of said combustion cycle wherein when said valve mechanism is disposed at said first one of said three different positions for achieving said VENTING stage of said combustion cycle, said fresh air intake and said exhaust ports are open so as to permit fresh air to enter into the first and second combustion chambers whereby combustion products within the first and second combustion chambers can be exhausted from the first and second combustion chambers, wherein when said valve mechanism is disposed at said second one of said three different positions for achieving said MIXING stage of said combustion cycle, said fresh air intake and said exhaust ports are closed so as to permit an air-fuel mixture disposed within the first and second combustion chambers to be recirculated within the first and second combustion chambers, and wherein when said valve mechanism is disposed at said third one of said three different positions for achieving said FIRING stage of said combustion cycle, said fresh air intake and said exhaust ports are closed and the first and second combustion chambers are fluidically connected together only by said at least one fluid passageway such that combustion, initiated within the first combustion chamber, can only proceed into the second combustion chamber through said at least one fluid passageway and the fluid port.

2. The valve assembly as set forth in claim 1, wherein:

said valve mechanism comprises a rotary valve mechanism which is rotatably movable between each of said first, second, and third ones of said three different positions for respectively achieving said VENTING, MIXING, and FIRING stages of said combustion cycle.

3. The valve assembly as set forth in claim 1, wherein:

said valve mechanism comprises a linear-rotary valve mechanism wherein a structural component of said linear-rotary valve mechanism is linearly movable from a first position, at which said VENTING stage of said combustion cycle is able to be achieved, to a second position at which said MIXING state of said combustion cycle is able to be achieved, and wherein a structural component of said linear-rotary valve mechanism is rotatably movable from said second position, at which said MIXING stage of said combustion cycle is able to be achieved, to a third position at which said FIRING stage of said combustion cycle is able to be achieved.

4. The valve assembly as set forth in claim 2, wherein said rotary valve mechanism comprises:

a cylindrical shank member;

said exhaust port comprises a through-bore defined within a lower region of said cylindrical shank member; and a pair of plenum chambers are defined upon opposite sides of said cylindrical shank member for respectively fluidically interconnecting the first and second combustion chambers to each other during said VENTING and MIXING stages of said combustion cycle.

5. The valve assembly as set forth in claim 3, wherein said linear-rotary valve mechanism comprises:

a first radially outer annular combustion chamber housing defining a first combustion chamber therewithin;

a second radially inner annular combustion chamber housing defining a second combustion chamber therewithin;

said fresh air intake port is defined within said second radially inner combustion chamber housing; and said exhaust port is defined within said first radially outer combustion chamber housing.

6. The valve assembly as set forth in claim 5, wherein:

said first radially outer combustion chamber housing comprises a radially inner annular wall member, a radially outer wall member, an upper wall member, and a lower wall member; and said second radially inner combustion chamber housing comprises a radially inner annular wall member, a radially outer wall member, and an upper wall member, wherein when said valve mechanism is disposed at said first position at which said VENTING stage of said combustion cycle is able to be performed, said upper wall member of said first combustion chamber housing is spaced from said upper wall member of said second combustion chamber housing so as to define therebetween a chamber for fluidically connecting said fresh air intake port of said second combustion chamber housing to the second combustion chamber.

7. The valve assembly as set forth in claim 6, wherein:

when said valve mechanism is disposed at said second position at which said MIXING stage of said combustion cycle is able to be performed, said upper wall member of said first combustion chamber housing is disposed in contact with said upper wall member of said second combustion chamber housing so as to collapse said chamber and cover said fresh air intake port whereby fresh air cannot flow into said chamber, and said radially outer wall member of said second combustion chamber housing covers said exhaust port whereby air cannot be exhausted.

8. The valve assembly as set forth in claim 6, further comprising:

first aperture means defined upon said radially inner annular wall member of said first radially outer combustion chamber housing; and second aperture means defined upon said radially inner annular wall member of said second radially inner combustion chamber housing, wherein when said valve mechanism is disposed at said second position at which said MIXING stage of said combustion cycle is able to be performed, said first and second aperture means of said first and second combustion chamber housings are aligned with respect to each other so as to permit the air-fuel mixture to be fluidically recirculated through the first and second combustion chambers, whereas when said valve mechanism is disposed at said third position at which said FIRING stage of said combustion cycle is able to be performed, said first and second aperture means of said first and second combustion chamber housings are nonaligned with respect to each other so as to prevent fluid recirculation between the first and second combustion chambers and to permit combustion flow from the first combustion chamber into the second combustion chamber only through the fluid port.

9. The valve assembly as set forth in claim 1, wherein:

said valve mechanism comprises a linear valve mechanism which is linearly movable between each of said first, second, and third ones of said three different positions for respectively achieving said VENTING, MIXING, and FIRING stages of said combustion cycle.

10. The valve assembly as set forth in claim 9, wherein said linear valve mechanism comprises:

a first radially outer annular combustion chamber housing defining a first combustion chamber therewithin;

a second radially inner annular combustion chamber housing defining a second combustion chamber therewithin;

said fresh air intake port and said exhaust port are defined between upper and lower end portions of said first and second combustion chambers; and said at least one fluid passageway operatively associated with said valve mechanism for fluidically interconnecting said first and second combustion chambers to each other during each of first, second, and third ones of three different positions of said valve mechanism for respectively achieving said VENTING, MIXING, and FIRING stages of said combustion cycle comprises a plurality of first and second fluid passageways which are respectively defined within side wall portions of said first and second combustion chambers, which are adapted to be aligned with respect to each other so as to permit fluidic communication between said first and second combustion chambers when said valve mechanism is disposed at each one of said first and second positions for achieving said VENTING and MIXING stages of said combustion cycle, and which are adapted to be non-aligned with respect to each other so as to prevent fluidic communication between said first and second combustion chambers when said valve mechanism is disposed at said third position, for achieving said FIRING stage of said combustion cycle, other than by the fluid port.

11. The valve mechanism as set forth in claim 10, wherein:

when said valve mechanism is disposed at said third position at which said plurality of first and second fluid passageways of said first and second combustion chambers are non-aligned with respect to each other, non-apertured side wall portions of said first combustion chamber cover said plurality of second fluid passageways defined within said side walls portions of said second combustion chamber, and non-apertured side wall portions of said second combustion chamber cover said plurality of first fluid passageways defined within said side walls portions of said first combustion chamber.

12. A dual combustion chamber system, comprising:

a first combustion chamber;

a second combustion chamber;

a fluid port interposed between said first and second combustion chambers for fluidically connecting said first combustion chamber to said second combustion chamber;

a valve mechanism;

a fresh air intake port defined within said valve mechanism for providing fresh air into said first and second combustion chambers so as to vent combustion products from said first and second combustion chambers following a FIRING stage of a combustion cycle;

an exhaust port defined within said valve mechanism for permitting the combustion products within said first and second combustion chambers to be exhausted from said first and second combustion chambers following said FIRING stage of said combustion cycle; and at least one fluid passageway operatively associated with said valve mechanism for fluidically interconnecting said first and second combustion chambers to each other during each of first, second, and third ones of three different positions of said valve mechanism for respectively achieving VENTING, MIXING, and FIRING stages of said combustion cycle wherein when said valve mechanism is disposed at said first one of said three different positions for achieving said VENTING stage of said combustion cycle, said fresh air intake and said exhaust ports are open so as to permit fresh air to enter into said first and second combustion chambers whereby combustion products within said first and second combustion chambers can be exhausted from said first and second combustion chambers, wherein when said valve mechanism is disposed at said second one of said three different positions for achieving said MIXING stage of said combustion cycle, said fresh air intake and said exhaust ports are closed so as to permit an air-fuel mixture disposed within said first and second combustion chambers to be recirculated within said first and second combustion chambers, and wherein when said valve mechanism is disposed at said third one of said three different positions for achieving said FIRING stage of said combustion cycle, said fresh air intake and said exhaust ports are closed and said first and second combustion chambers are fluidically connected together only by said at least one fluid passageway such that combustion, initiated within said first combustion chamber, can only proceed into said second combustion chamber through said at least one fluid passageway and said fluid port.

13. The dual combustion chamber system as set forth in claim 12, wherein:

said valve mechanism comprises a rotary valve mechanism which is rotatably movable between each of said first, second, and third ones of said three different positions for respectively achieving said VENTING, MIXING, and FIRING stages of said combustion cycle.

14. The dual combustion chamber system as set forth in claim 12, wherein:

said valve mechanism comprises a linear-rotary valve mechanism wherein a structural component of said linear-rotary valve mechanism is linearly movable from a first position, at which said VENTING stage of said combustion cycle is able to be achieved, to a second position at which said MIXING state of said combustion cycle is able to be achieved, and wherein a structural component of said linear-rotary valve mechanism is rotatably movable from said second position, at which said MIXING stage of said combustion cycle is able to be achieved, to a third position at which said FIRING stage of said combustion cycle is able to be achieved.

15. The dual combustion chamber system as set forth in claim 13, wherein said rotary valve mechanism comprises:

a cylindrical shank member;

said exhaust port comprises a through-bore defined within a lower region of said cylindrical shank member; and a pair of plenum chambers are defined upon opposite sides of said cylindrical shank member for respectively fluidically interconnecting the first and second combustion chambers to each other during said VENTING and MIXING stages of said combustion cycle.

16. The dual combustion chamber system as set forth in claim 15, further comprising:

a combustion chamber body member;

said first combustion chamber comprises an annular chamber defined within said combustion chamber body member and disposed around said second combustion chamber; and a rotary valve housing is defined within said combustion chamber body member for accommodating said rotary valve mechanism.

17. The dual combustion chamber system as set forth in claim 16, wherein:

said first combustion chamber comprises a plurality of circumferentially extending partitions which effectively divide said first combustion chamber into a plurality of combustion chamber segments which together define a serpentine configuration.

18. The dual combustion chamber system as set forth in claim 16, wherein:

a plurality of apertures are defined within opposite sides of said rotary valve housing for fluidic communication with said pair of plenum chambers.

19. The dual combustion chamber system as set forth in claim 14, wherein said linear-rotary valve mechanism comprises:

a first radially outer annular combustion chamber housing defining a first combustion chamber therewithin;

a second radially inner annular combustion chamber housing defining a second combustion chamber therewithin;

said fresh air intake port is defined within said second radially inner combustion chamber housing; and said exhaust port is defined within said first radially outer combustion chamber housing.

20. The dual combustion chamber system as set forth in claim 19, wherein:

said first radially outer combustion chamber housing comprises a radially inner annular wall member, a radially outer wall member, an upper wall member, and a lower wall member; and said second radially inner combustion chamber housing comprises a radially inner annular wall member, a radially outer wall member, and an upper wall member, wherein when said valve mechanism is disposed at said first position at which said VENTING stage of said combustion cycle is able to be performed, said upper wall member of said first combustion chamber housing is spaced from said upper wall member of said second combustion chamber housing so as to define therebetween a chamber for fluidically connecting said fresh air intake port of said second combustion chamber housing to said second combustion chamber.

21. The dual combustion chamber system as set forth in claim 20, wherein:

when said valve mechanism is disposed at said second position at which said MIXING stage of said combustion cycle is able to be performed, said upper wall member of said first combustion chamber housing is disposed in contact with said upper wall member of said second combustion chamber housing so as to collapse said chamber and cover said fresh air intake port whereby fresh air cannot flow into said chamber, and said radially outer wall member of said second combustion chamber housing covers said exhaust port whereby air cannot be exhausted.

22. The dual combustion chamber system as set forth in claim 20, further comprising:

first aperture means defined upon said radially inner annular wall member of said first radially outer combustion chamber housing; and second aperture means defined upon said radially inner annular wall member of said second radially inner combustion chamber housing, wherein when said valve mechanism is disposed at said second position at which said MIXING stage of said combustion cycle is able to be performed, said first and second aperture means of said first and second combustion chamber housings are aligned with respect to each other so as to permit the air-fuel mixture to be fluidically recirculated through said first and second combustion chambers, whereas when said valve mechanism is disposed at said third position at which said FIRING stage of said combustion cycle is able to be performed, said first and second aperture means of said first and second combustion chamber housings are non-aligned with respect to each other so as to prevent fluid recirculation between said first and second combustion chambers and to permit combustion flow from said first combustion chamber into said second combustion chamber only through said fluid port.

23. The dual combustion chamber system as set forth in claim 19, wherein:

said first combustion chamber comprises a plurality of axially oriented partitions which effectively divide said first combustion chamber into a plurality of combustion chamber segments which together define a serpentine configuration.

24. The dual combustion chamber system as set forth in claim 12, wherein:

said valve mechanism comprises a linear valve mechanism which is linearly movable between each of said first, second, and third ones of said three different positions for respectively achieving said VENTING, MIXING, and FIRING stages of said combustion cycle.

25. The dual combustion chamber system as set forth in claim 24, wherein said linear valve mechanism comprises:

a first radially outer annular combustion chamber housing defining a first combustion chamber therewithin;

a second radially inner annular combustion chamber housing defining a second combustion chamber therewithin;

said fresh air intake port and said exhaust port are defined between upper and lower end portions of said first and second combustion chambers; and said at least one fluid passageway operatively associated with said valve mechanism for fluidically interconnecting said first and second combustion chambers to each other during each of first, second, and third ones of three different positions of said valve mechanism for respectively achieving said VENTING, MIXING, and FIRING stages of said combustion cycle comprises a plurality of first and second fluid passageways which are respectively defined within side wall portions of said first and second combustion chambers, which are adapted to be aligned with respect to each other so as to permit fluidic communication between said first and second combustion chambers when said valve mechanism is disposed at each one of said first and second positions for achieving said VENTING and MIXING stages of said combustion cycle, and which are adapted to be non-aligned with respect to each other so as to prevent fluidic communication between said first and second combustion chambers when said valve mechanism is disposed at said third position, for achieving said FIRING stage of said combustion cycle, other than by said fluid port.

26. The dual combustion chamber system as set forth in claim 25, wherein:

when said valve mechanism is disposed at said third position at which said plurality of first and second fluid passageways of said first and second combustion chambers are non-aligned with respect to each other, non-apertured side wall portions of said first combustion chamber cover said plurality of second fluid passageways defined within said side walls portions of said second combustion chamber, and non-apertured side wall portions of said second combustion chamber cover said plurality of first fluid passageways defined within said side walls portions of said first combustion chamber.

27. A fastener-driving tool for driving a fastener into a workpiece, comprising:

a cylinder member;

a piston-driver assembly movably disposed within said cylinder member for driving a fastener through and out from said fastener-driving tool;

a first combustion chamber defined within said fastener-driving tool;

a second combustion chamber defined within said fastener-driving tool;

a fluid port interposed between said first and second combustion chambers for fluidically connecting said first combustion chamber to said second combustion chamber;

a valve mechanism;

a fresh air intake port defined within said valve mechanism for providing fresh air into said first and second combustion chambers so as to vent combustion products from said first and second combustion chambers following a FIRING stage of a combustion cycle;

an exhaust port defined within said valve mechanism for permitting the combustion products within said first and second combustion chambers to be exhausted from said first and second combustion chambers following said FIRING stage of said combustion cycle; and at least one fluid passageway operatively associated with said valve mechanism for fluidically interconnecting said first and second combustion chambers to each other during each of first, second, and third ones of three different positions of said valve mechanism for respectively achieving VENTING, MIXING, and FIRING stages of said combustion cycle wherein when said valve mechanism is disposed at said first one of said three different positions for achieving said VENTING stage of said combustion cycle, said fresh air intake and said exhaust ports are open so as to permit fresh air to enter into said first and second combustion chambers whereby combustion products within said first and second combustion chambers can be exhausted from said first and second combustion chambers, wherein when said valve mechanism is disposed at said second one of said three different positions for achieving said MIXING stage of said combustion cycle, said fresh air intake and said exhaust ports are closed so as to permit an air-fuel mixture disposed within said first and second combustion chambers to be recirculated within said first and second combustion chambers, and wherein when said valve mechanism is disposed at said third one of said three different positions for achieving said FIRING stage of said combustion cycle, said fresh air intake and said exhaust ports are closed and said first and second combustion chambers are fluidically connected together only by said at least one fluid passageway such that combustion, initiated within said first combustion chamber, can only proceed into said second combustion chamber through said at least one fluid passageway and said fluid port whereupon energy and power generated within said first and second combustion chambers impact upon said piston-driver assembly for moving said piston-driver assembly in order to drive a fastener through and out from said fastener-driving tool.

28. The fastener-driving tool as set forth in claim 27, wherein:

said valve mechanism comprises a rotary valve mechanism which is rotatably movable between each of said first, second, and third ones of said three different positions for respectively achieving said VENTING, MIXING, and FIRING stages of said combustion cycle.

29. The fastener-driving tool as set forth in claim 27, wherein:

said valve mechanism comprises a linear-rotary valve mechanism wherein a structural component of said rotary-linear valve mechanism is linearly movable from a first position, at which said VENTING stage of said combustion cycle is able to be achieved, to a second position at which said MIXING state of said combustion cycle is able to be achieved, and wherein a structural component of said linear-rotary valve mechanism is rotatably movable from said second position, at which said MIXING stage of said combustion cycle is able to be achieved, to a third position at which said FIRING stage of said combustion cycle is able to be achieved.

30. The fastener driving tool as set forth in claim 28, wherein said rotary valve mechanism comprises:

a cylindrical shank member;

said exhaust port comprises a through-bore defined within a lower region of said cylindrical shank member; and a pair of plenum chambers are defined upon opposite sides of said cylindrical shank member for respectively fluidically interconnecting the first and second combustion chambers to each other during said VENTING and MIXING stages of said combustion cycle.

31. The fastener-driving tool as set forth in claim 30, further comprising:

a combustion chamber body member;

said first combustion chamber comprises an annular chamber defined within said combustion chamber body member and disposed around said second combustion chamber; and a rotary valve housing is defined within said combustion chamber body member for accommodating said rotary valve mechanism.

32. The fastener-driving tool as set forth in claim 31, wherein:

said first combustion chamber comprises a plurality of circumferentially extending partitions which effectively divide said first combustion chamber into a plurality of combustion chamber segments which together define a serpentine configuration.

33. The fastener-driving tool as set forth in claim 31, wherein:

a plurality of apertures are defined within opposite sides of said rotary valve housing for fluidic communication with said pair of plenum chambers.

34. The fastener-driving tool as set forth in claim 29, wherein said linear-rotary valve mechanism comprises:

a first radially outer annular combustion chamber housing defining a first combustion chamber therewithin;

a second radially inner annular combustion chamber housing defining a second combustion chamber therewithin;

said fresh air intake port is defined within said second radially inner combustion chamber housing; and said exhaust port is defined within said first radially outer combustion chamber housing.

35. The fastener-driving tool as set forth in claim 34, wherein:

said first radially outer combustion chamber housing comprises a radially inner annular wall member, a radially outer wall member, an upper wall member, and a lower wall member; and said second radially inner combustion chamber housing comprises a radially inner annular wall member, a radially outer wall member, and an upper wall member, wherein when said valve mechanism is disposed at said first position at which said VENTING stage of said combustion cycle is able to be performed, said upper wall member of said first combustion chamber housing is spaced from said upper wall member of said second combustion chamber housing so as to define therebetween a chamber for fluidically connecting said fresh air intake port of said second combustion chamber housing to said second combustion chamber.

36. The fastener-driving tool as set forth in claim 35, wherein:

when said valve mechanism is disposed at said second position at which said MIXING stage of said combustion cycle is able to be performed, said upper wall member of said first combustion chamber housing is disposed in contact with said upper wall member of said second combustion chamber housing so as to collapse said chamber and cover said fresh air intake port whereby fresh air cannot flow into said chamber, and said radially outer wall member of said second combustion chamber housing covers said exhaust port whereby air cannot be exhausted.

37. The fastener-driving tool as set forth in claim 35, further comprising:

first aperture means defined upon said radially inner annular wall member of said first radially outer combustion chamber housing; and second aperture means defined upon said radially inner annular wall member of said second radially inner combustion chamber housing, wherein when said valve mechanism is disposed at said second position at which said MIXING stage of said combustion cycle is able to be performed, said first and second aperture means of said first and second combustion chamber housings are aligned with respect to each other so as to permit the air-fuel mixture to be fluidically recirculated through said first and second combustion chambers, whereas when said valve mechanism is disposed at said third position at which said FIRING stage of said combustion cycle is able to be performed, said first and second aperture means of said first and second combustion chamber housings are non-aligned with respect to each other so as to prevent fluid recirculation between said first and second combustion chambers and to permit combustion flow from said first combustion chamber into said second combustion chamber only through said fluid port whereupon energy and power generated within said first and second combustion chambers impact upon said piston-driver assembly for moving said piston-driver assembly in order to drive a fastener through and out from said fastener-driving tool.

38. The fastener-driving tool as set forth in claim 27, wherein:

said first combustion chamber comprises a plurality of axially oriented partitions which effectively divide said first combustion chamber into a plurality of combustion chamber segments which together define a serpentine configuration.

39. The fastener-driving tool as set forth in claim 27, wherein:

said valve mechanism comprises a linear valve mechanism which is linearly movable between each of said first, second, and third ones of said three different positions for respectively achieving said VENTING, MIXING, and FIRING stages of said combustion cycle.

40. The fastener-driving tool as set forth in claim 39, wherein said linear valve mechanism comprises:

a first radially outer annular combustion chamber housing defining a first combustion chamber therewithin;

a second radially inner annular combustion chamber housing defining a second combustion chamber therewithin;

said fresh air intake port and said exhaust port are defined between upper and lower end portions of said first and second combustion chambers; and said at least one fluid passageway operatively associated with said valve mechanism for fluidically interconnecting said first and second combustion chambers to each other during each of first, second, and third ones of three different positions of said valve mechanism for respectively achieving said VENTING, MIXING, and FIRING stages of said combustion cycle comprises a plurality of first and second fluid passageways which are respectively defined within side wall portions of said first and second combustion chambers, which are adapted to be aligned with respect to each other so as to permit fluidic communication between said first and second combustion chambers when said valve mechanism is disposed at each one of said first and second positions for achieving said VENTING and MIXING stages of said combustion cycle, and which are adapted to be non-aligned with respect to each other so as to prevent fluidic communication between said first and second combustion chambers when said valve mechanism is disposed at said third position, for achieving said FIRING stage of said combustion cycle, other than by said fluid port.

41. The fastener-driving tool as set forth in claim 40, wherein:

when said valve mechanism is disposed at said third position at which said plurality of first and second fluid passageways of said first and second combustion chambers are non-aligned with respect to each other, non-apertured side wall portions of said first combustion chamber cover said plurality of second fluid passageways defined within said side walls portions of said second combustion chamber, and non-apertured side wall portions of said second combustion chamber cover said plurality of first fluid passageways defined within said side walls portions of said first combustion chamber.

* * * * *